US010648168B2

(12) United States Patent
Rossi

(10) Patent No.: US 10,648,168 B2
(45) Date of Patent: May 12, 2020

(54) RAPID DEPLOYMENT SHELTERS AND SHELTER SYSTEMS

(71) Applicant: The Cricket System Incorporated, Newburyport, MA (US)

(72) Inventor: John D. Rossi, Newburyport, MA (US)

(73) Assignee: The Cricket System Incorporated, Newburyport, MA (US)

( * ) Notice: Subject to any disclaimer, the term of this patent is extended or adjusted under 35 U.S.C. 154(b) by 63 days.

(21) Appl. No.: 15/006,890

(22) Filed: Jan. 26, 2016

(65) Prior Publication Data

US 2016/0222644 A1 Aug. 4, 2016

Related U.S. Application Data

(60) Provisional application No. 62/107,925, filed on Jan. 26, 2015.

(51) Int. Cl.

| | |
|---|---|
| ***E04B 1/343*** | (2006.01) |
| ***E04H 15/00*** | (2006.01) |
| ***E04H 1/12*** | (2006.01) |

(52) U.S. Cl.

CPC ..... *E04B 1/34321* (2013.01); *E04H 1/1205* (2013.01); *E04H 15/008* (2013.01); *E04B 2001/34389* (2013.01)

(58) Field of Classification Search

CPC ..... E04H 15/008; E04H 15/36; E04H 15/405; E04H 15/44; E04H 15/48; E04H 15/56; E04H 1/005; E04H 1/02; E04H 1/1205; E04H 2001/1283; E04B 2001/34389; E04B 2001/34876; E04B 2001/34884; E04B 1/3432; E04B 1/34357; E04B 1/34373; E04B 1/34384; E04B 1/343; E04B 1/34315; E04B 1/34321; B60P 3/341; B60P 3/32; B60P 3/34

See application file for complete search history.

(56) References Cited

U.S. PATENT DOCUMENTS

| | | | |
|---|---|---|---|
| 2,711,564 | A | 6/1955 | Jackson |
| 2,728,956 | A | 1/1956 | Jackson |
| 2,733,784 | A | 2/1956 | Berry |

(Continued)

FOREIGN PATENT DOCUMENTS

| | | |
|---|---|---|
| CN | 3245980 | 7/2002 |
| WO | WO 2016/123121 | 8/2016 |

OTHER PUBLICATIONS http://visible-good.com/shelters/ Available Apr. 9, 2016.

(Continued)

*Primary Examiner* — Jessica L Laux

(74) *Attorney, Agent, or Firm* — Morse, Barnes-Brown & Pendleton, P.C.; Lisa M. Warren, Esq.; Stanley F. Chalvire, Esq.

(57) ABSTRACT

Disclosed are shelters and shelter systems that may be conveniently and rapidly deployed. In certain aspects, the shelter systems disclosed herein are self-contained when configured in a stowed configuration and may be rapidly deployed by one or more users without the use of tools, thereby making them particularly useful for deployment, for example, in disaster-stricken areas. Also disclosed are composite insulating materials that may be used to construct various structures, including the shelters and shelter systems disclosed herein.

22 Claims, 24 Drawing Sheets

(56) References Cited

U.S. PATENT DOCUMENTS

| | | | | |
|---|---|---|---|---|
| 2,886,860 | A | 5/1959 | Zern | |
| 3,236,014 | A * | 2/1966 | Edgar | E04B 1/14 52/270 |
| 3,292,314 | A * | 12/1966 | Heise | E04B 1/343 52/126.7 |
| 3,688,458 | A * | 9/1972 | Inmon | A47B 47/0041 52/280 |
| 3,778,528 | A | 12/1973 | Heifetz | |
| D249,963 | S | 10/1978 | Cosentino | |
| 4,500,592 | A | 2/1985 | Lee et al. | |
| 5,161,329 | A | 11/1992 | Brown | |
| D378,543 | S | 3/1997 | Davlantes | |
| 5,822,931 | A | 10/1998 | Galowitz | |
| D406,904 | S | 3/1999 | Sronce | |
| 6,955,845 | B1 * | 10/2005 | Poole | B32B 3/02 296/39.3 |
| D580,507 | S | 11/2008 | Huerta | |
| 2003/0140573 | A1 * | 7/2003 | Marcinkowski | E04B 1/34321 52/79.5 |
| 2006/0249190 | A1 * | 11/2006 | Fritzsche | E04H 15/20 135/116 |
| 2007/0204514 | A1 | 9/2007 | Grimmett | |
| 2008/0106137 | A1 | 5/2008 | Paton-Ash et al. | |
| 2008/0110484 | A1 * | 5/2008 | Doran | E04B 1/34315 135/121 |
| 2012/0006369 | A1 | 1/2012 | Cantin et al. | |
| 2013/0217318 | A1 * | 8/2013 | Edwards | E04D 1/24 454/366 |
| 2014/0069032 | A1 * | 3/2014 | Philibert | E04B 1/34321 52/79.9 |
| 2014/0090312 | A1 * | 4/2014 | Medley | E04B 1/34357 52/79.5 |
| 2014/0157685 | A1 * | 6/2014 | Fagan | E04H 1/12 52/79.5 |
| 2014/0366470 | A1 * | 12/2014 | Edwards | E04D 1/24 52/232 |
| 2016/0017653 | A1 * | 1/2016 | Bottin | E04B 1/3483 52/79.1 |
| 2016/0201385 | A1 | 7/2016 | Ward | |

OTHER PUBLICATIONS https://www.losberger.com/us/en_US/datasheet/heavy-duty-tag/ Retrieved Dec. 15, 2016.

The Visible Good RDM (Henry Repeating Arms) Feb. 2, 2013, accessed Apr. 12, 2016 at <https://vimeo.com/59993872>.

The Disaster Shelter You Want to Live in Way More Than a FEMA Trailer (Schwartz) Mar. 13, 2013, accessed at < https://www.fastcompany.com/2681527/the-disaster-shelter-you-want-to-live-in-way-more-than-a-fema-trailer >.

International Search Report fir International Application No. PCT/US2016/014948, dated Jul. 8, 2016.

Notice of Allowance and Fee(s) Due issued in U.S. Appl. No. 29/544,993, dated Mar. 24, 2017.

Schwartz, Ariel, "The Disaster Shelter You Want to Live in Way More Than a FEMA Trailer," including embedded video, *Co.exist,* (Mar. 13, 2013). Retrieved from the Internet <URL: http://www.fastcoexist.com/1681527/the-disaster-shelter-you-want-to-live-in-way-more-than-a-fema-trailer> on May 26, 2016.

* cited by examiner

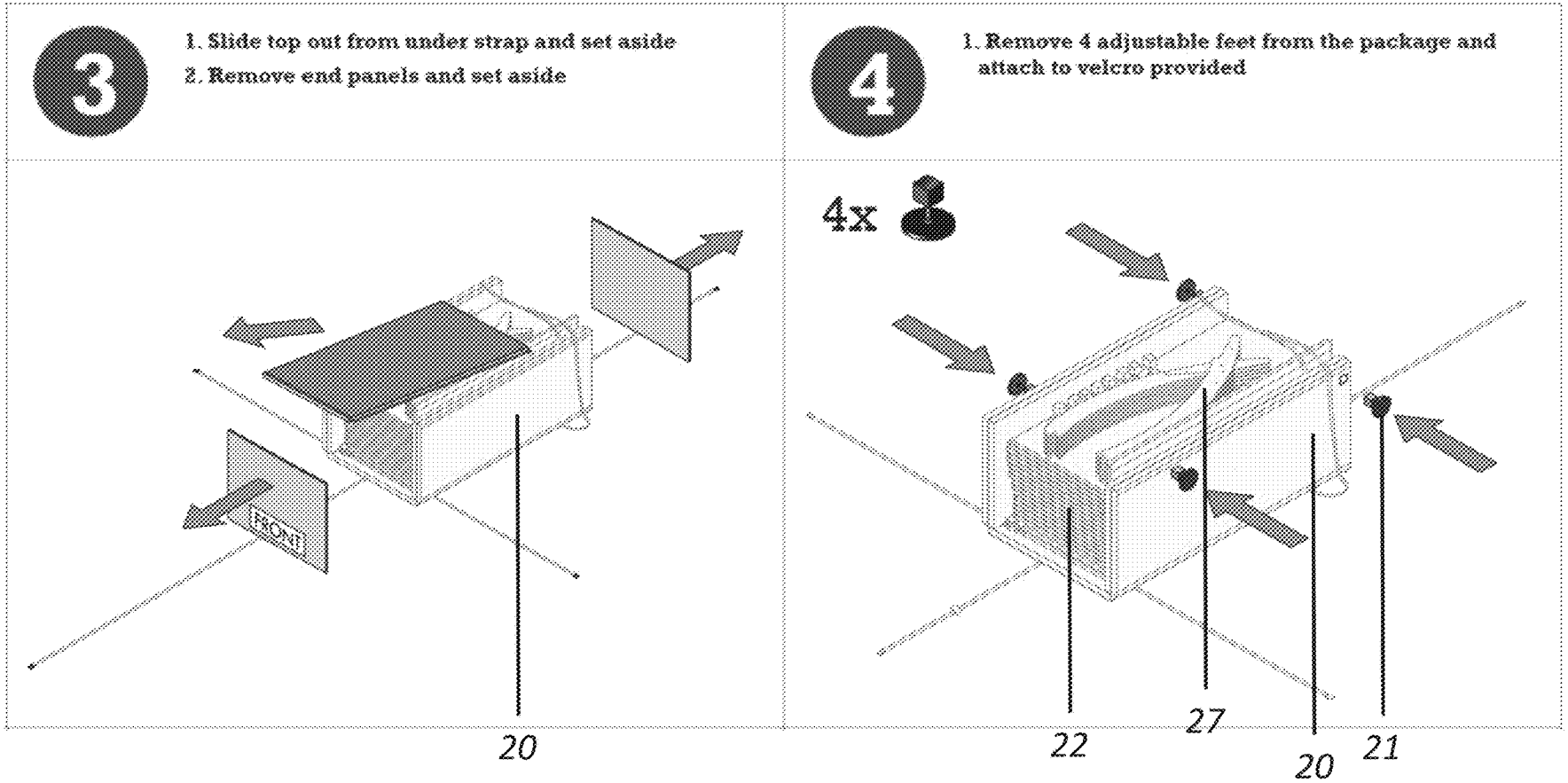
FIG. 6A Con't

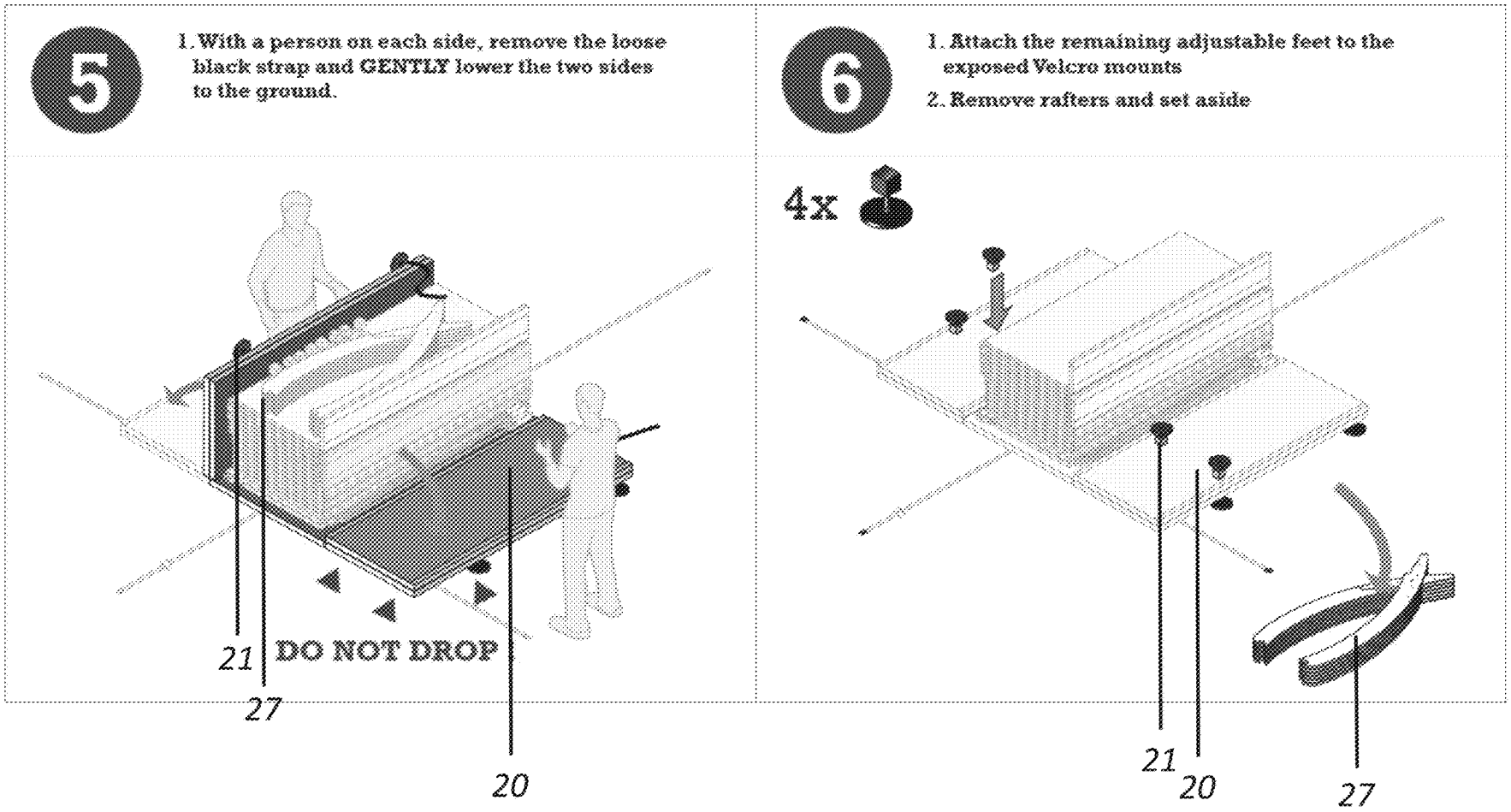
FIG. 6A Con't

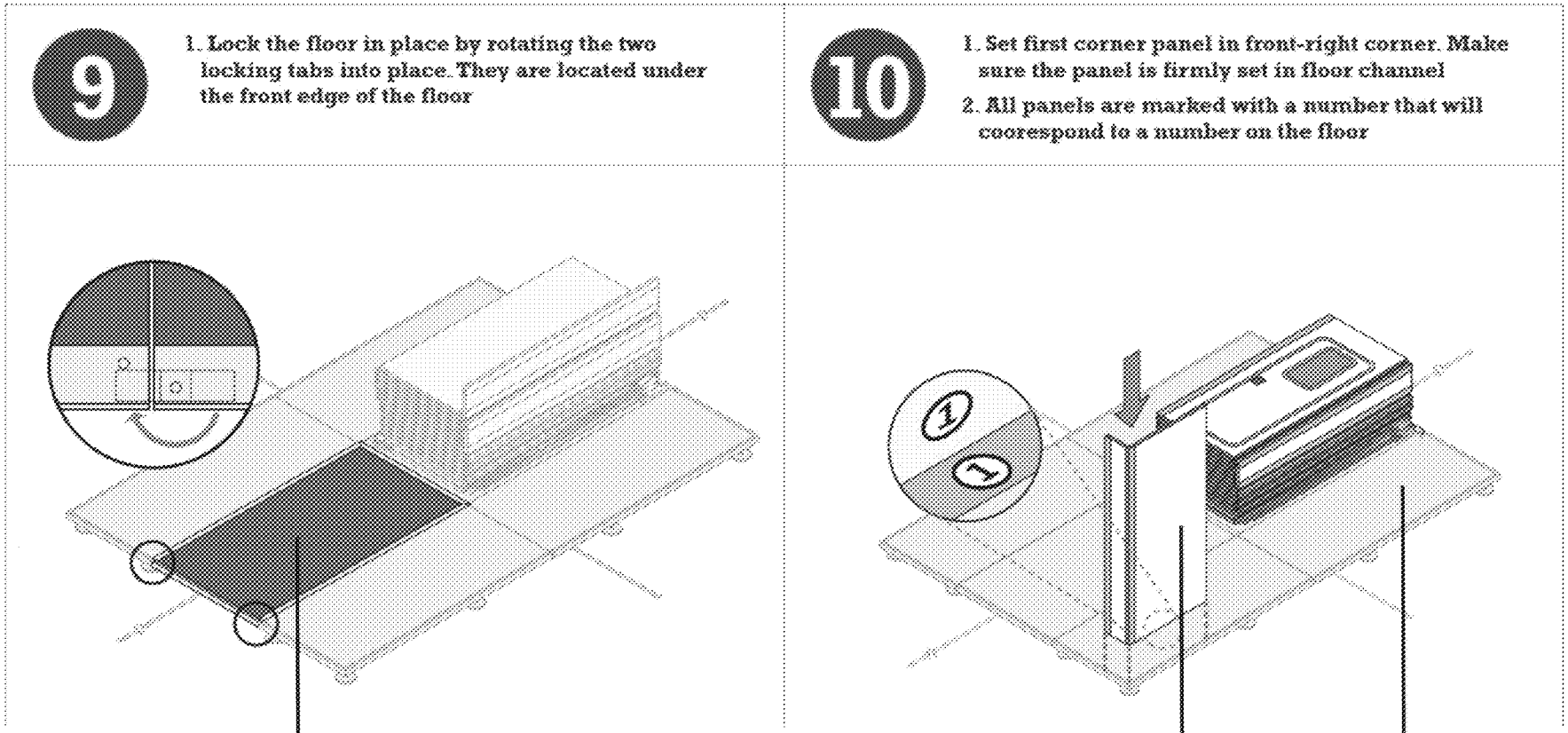
FIG. 6B Con't

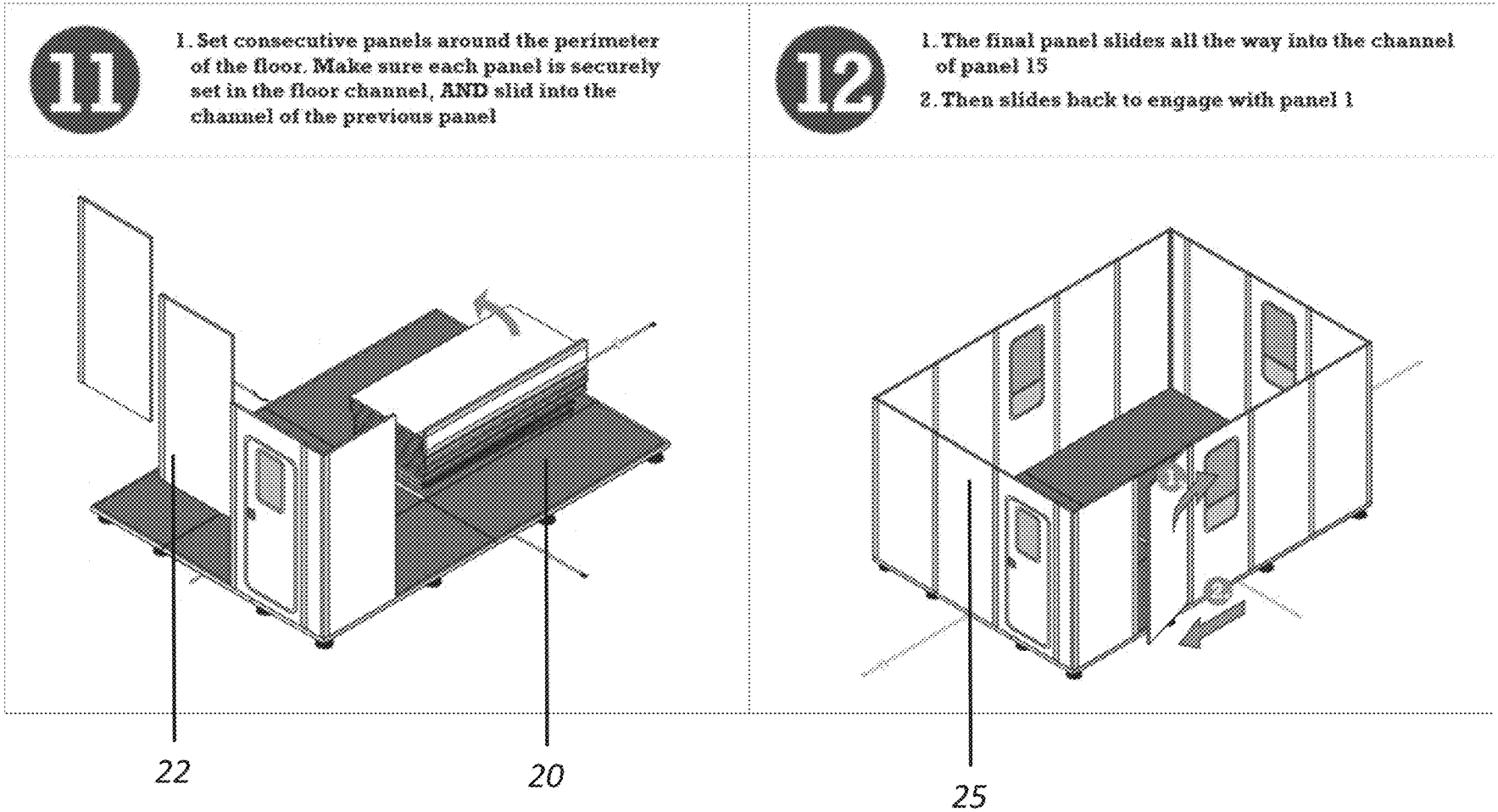
*FIG. 6B Con't*

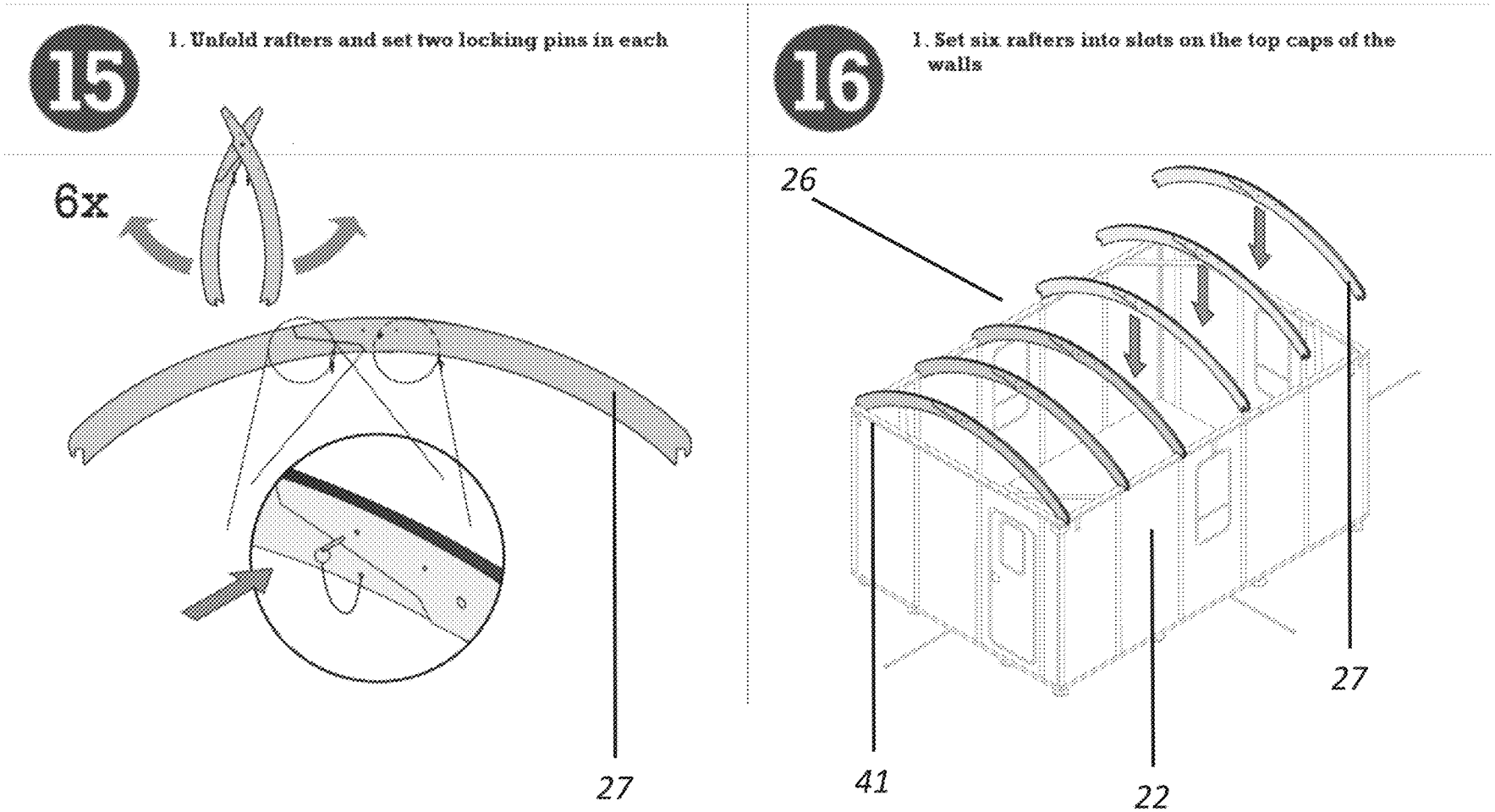
FIG. 6C Con't

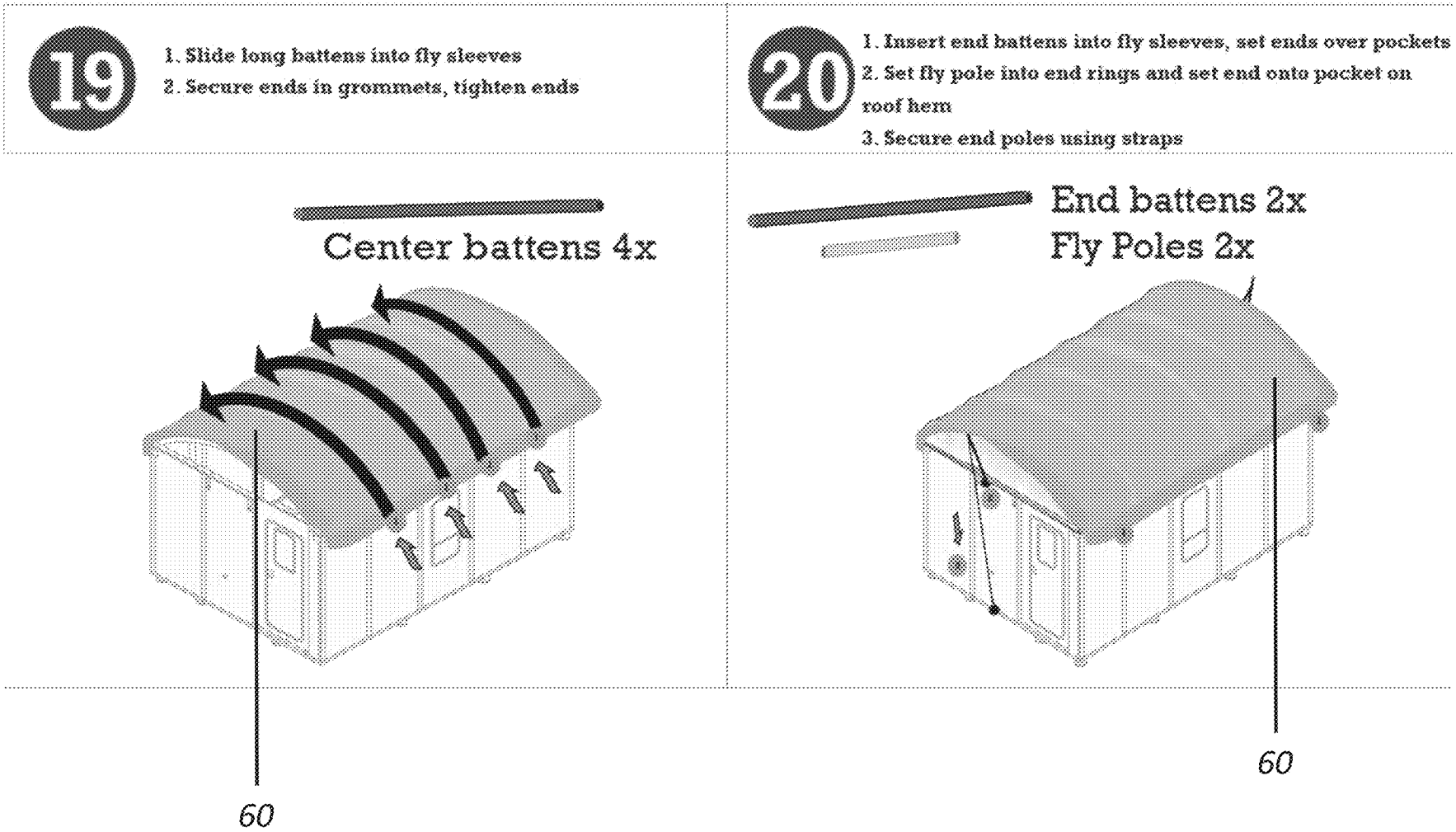
FIG. 6D Con't

7A

7B

7C

7D

8A

8B

8C

14A

14B

RAPID DEPLOYMENT SHELTERS AND SHELTER SYSTEMS

RELATED APPLICATIONS

This application claims the benefit of U.S. Provisional Application Ser. No. 62/107,925, filed Jan. 26, 2015, the entire teachings of which are incorporated herein by reference.

BACKGROUND OF THE INVENTION

Shelter, food, water and clothing represent key human needs that are necessary to satisfy long-term physical well-being and survival. Providing basic shelter may be particularly difficult in impoverished regions or in response to a crisis situation, for example, in response to natural or man-made disasters or in relation to relief efforts.

While temporary shelter systems have been developed to facilitate responses to disaster relief efforts, such shelters may be difficult and time-consuming to assemble or deploy. Moreover, depending on the environment into which such shelters are to be deployed, the lack of electricity, tools and other resources may present specific challenges to an intended user that can dramatically limit the overall utility of such shelters.

Given the extreme conditions to which humans may be exposed during or immediately following a disaster event, it remains critical to quickly and efficiently fulfill the basic human need for shelter. Needed are temporary shelter structures and systems that fulfill the basic human need for shelter and that preferably provide a safe, secure and semi-permanent shelter structure to individuals in need thereof. Particularly needed are temporary shelter structures and systems that are capable of being quickly and easily deployed in response to, for example, a natural disaster event. In view of the harsh environments into which such shelter structures may be frequently deployed, such as for example, war zones or in connection with disaster relief efforts, also needed are shelters and shelter systems that lend themselves to easy assembly and disassembly.

SUMMARY OF THE INVENTION

Provided herein are shelters and shelter systems (e.g., temporary modular shelter systems) that are configured for easy shipment and straightforward assembly, making them particularly suitable for use, for example, in active combat zones or in connection with disaster relief efforts. In certain aspects, the shelters and shelter systems described herein may be assembled quickly and easily and without the use of special tools or skilled labor, making them particularly suitable for use in connection with, for example, disaster relief efforts or international development efforts in poverty stricken areas, where special tooling may not be readily accessible.

In certain aspects, disclosed herein are modular shelter systems comprising: a plurality of rigid floor panels; a plurality of rigid wall panels, each comprising a top end and a bottom end substantially parallel to the top end; a plurality of rigid top caps; a plurality of rafters, each comprising a first end and a second end comprising a rafter supporting member coupled thereto; and a roof structure; wherein the rigid floor panels may be configured into a folded state and a deployed state, wherein in the folded state the rigid floor panels form a container configured to securely house the shelter system in a stowed configuration, and wherein in the deployed state the floor panels form a floor of the shelter; wherein the floor of the shelter defines a perimeter of a shelter; wherein the perimeter of the shelter comprises an extrusion configured to perpendicularly and releasably couple the bottom end of the rigid wall panels to the floor to thereby form a wall of the shelter; wherein the top end of the rigid wall panels are configured to releasably couple to the rigid top caps and thereby stabilize the walls of the shelter; wherein the rigid top caps are configured to releasably couple to the rafter supporting members such that the rafter supporting members do not project beyond the walls of the shelter to thereby define a roof support structure; and wherein the roof support structure is configured to releasably couple to the roof structure to thereby form a roof of the shelter.

In certain aspects, also disclosed herein are modular shelters comprising: a plurality of walls, the walls comprising a plurality of rigid wall panels, the wall panels comprising a top end and a bottom end substantially parallel to the top end; a plurality of rigid top caps, wherein the top end of the rigid wall panels are releasably coupled to the rigid top caps and thereby stabilize the walls of the shelter; a floor, wherein the floor defines a perimeter of the shelter, and wherein the perimeter of the shelter comprises an extrusion configured to perpendicularly and releasably couple the bottom end of the rigid wall panels to the floor; and a roof comprising a roof support structure and a roof structure; wherein the roof support structure comprises a plurality of rafters, each comprising a first end and a second end comprising a rafter supporting member coupled thereto; wherein the rigid top caps are configured to releasably couple to the rafter supporting members such that the rafter supporting members do not project beyond the walls of the shelter to thereby form a roof support structure; and wherein a roof structure is releasably coupled to the roof support structure to thereby form the roof.

In certain embodiments, the floor of the shelters and shelter systems disclosed herein comprise a plurality of rigid floor panels. In certain aspects, the plurality of floor panels are thermally insulated (e.g., insulated with radiant barriers or films that incorporate an air space on each side of such radiant barriers or films). In some embodiments, one or more of the rigid floor panels are interconnected. In certain embodiments, the roof or the roof structure is thermally insulated (e.g., using a composite material comprising both reflective insulation and conductive insulation).

In some aspects, the shelter floor may be configured into a stowed or folded state. For example, in some embodiments, the floor panels that comprise the floor of the shelters and shelter systems disclosed herein may be assembled to form a container (e.g., a box) capable of housing the disassembled shelter or the components of the shelter system. In certain embodiments, the floor of the shelter or the floor panels that comprise the floor of the shelter may be assembled in a folded state, thereby forming a container configured to securely house the shelter system in a stowed configuration. For example, a plurality of interconnected (e.g., hinged) floor panels may be configured into a container (e.g., a crate or box) capable of housing the components of the shelters and shelter systems disclosed herein.

In certain embodiments, the walls of the shelters disclosed herein comprise, or may be assembled using, one or more rigid wall panels. For example, the walls of the shelter may be assembled by releasably coupling two or more wall panels to each other (e.g., using an integrated extrusion with pliable fins that is located on or integrated into one panel to releasably engage a thermoformed tongue located on the edge of an adjacent panel). Such rigid wall panels or the walls formed thereby may then be releasably coupled to the floor. In certain embodiments, the wall panels are thermally insulated (e.g., insulated with radiant barrier films that incorporate an air space on each side of such radiant barrier films). In certain aspects, the one or more of the wall panels comprise a door. In certain aspects, the one or more of the wall panels comprise a window. In still other embodiments, one or more of the door and windows comprises a means of securing such window or door (e.g., a lock).

In some embodiments, the shelters and assembled shelter systems disclosed herein comprise a front wall and a rear wall. In certain embodiments, the front wall is substantially parallel to the rear wall. In some embodiments, the shelters and assembled shelter systems disclosed herein comprise two or more side walls. In certain embodiments, where the shelter comprises two side walls, the two side walls are substantially parallel to each other.

It may be useful to elevate the shelters or assembled shelter systems disclosed herein off of the ground, for example, to keep the shelter and its contents away from insects, vermin or minor flooding. Accordingly, in certain embodiments, the rigid floor panels each comprise an underside, and the underside of the one or more of the rigid floor panels comprise a plurality of footings or supporting members. In certain aspects, the footings are configured to releasably couple to the underside of the rigid floor panels. In certain embodiments, the footings elevate the assembled floor and the shelter structure off of the ground. It may also be useful to elevate the shelter system in its stowed configuration, accordingly in certain embodiments footings may be attached to the floor panels that form the container of shelter system. In certain aspects, the footings are adjustable. In certain aspects, the adjustable footings provide a means of levelling the shelter or assembled shelter system. For example, the footings may be adjusted to level a shelter that is placed on uneven terrain.

The shelters and assembled shelter systems disclosed herein comprise a roof. The roof of the shelter may be assembled by coupling (e.g., releasably coupling) a roof structure (e.g., a fabric or flexible roof structure) to a roof support structure (e.g., a roof support structure formed by a plurality of rafters prepared using wood, plywood, metal or thermoformed plastic). For example, the roof of the shelter may be formed or assembled by releasably coupling a flexible roof structure to an underlying plurality of rafters. In certain embodiments, the rafters do not project beyond the top caps. In certain embodiments, the roof comprises a roof support structure and a roof structure. In certain embodiments, the assembled roof of the shelter provides stability to the shelter (e.g., the assembled roof further stabilizes the walls of the shelter).

In certain embodiments, the roof support structure comprises a plurality of rafters. In some embodiments, the rafters are telescopic, foldable or retractable. In certain embodiments, the roof structure is flexible. For example, in certain embodiments, the roof structure may comprise a vented fabric roof. In some embodiments, the roof structure seals the shelter to the elements (e.g., the assembled roof forms a weather tight or a watertight seal when coupled to the roof support structure). In those embodiments in which the roof structure is a vented fabric roof, the hems of such fabric roof may comprise one or more stiffeners to impart added strength and durability to such fabric roof. In certain embodiments, the roof of the shelter is curved or barreled.

In certain embodiments, the shelters and shelter systems disclosed herein further comprise a shade fly. For example, such a shade fly may be assembled over the roof of the shelter and provide shade and/or passive cooling to the assembled shelter.

In certain embodiments, the extrusion comprises a spring clip. For example, the extrusion may comprise a spring clip that is configured to perpendicularly and releasably accept the bottom end of the wall panels. In certain embodiments, the extrusion is integrated into the floor panels and/or wall panels. For example, such an integrated extrusion may be formed, molded or otherwise configured on the side, edge or end of a wall panel and configured to engage a thermoformed tongue on one or more sides, edges or ends of an adjacent wall panel and/or floor panel. In certain aspects, such an integrated extrusion may comprise or otherwise may be formed with one or more pliable fins.

In some embodiments, the shelters and shelter systems disclosed herein comprise means to secure the assembled shelter to the ground. For example, in certain embodiments, the shelters and shelter systems disclosed herein also comprise one or more ground anchors.

In certain aspects, the shelters and shelter systems disclosed herein are easily assembled and disassembled. Accordingly, in certain embodiments, the assembled shelters may be disassembled, for example, disassembled without tools. In some embodiments, the shelters disclosed herein may be assembled without tools. Similarly, in certain embodiments, the shelters and shelter systems disclosed herein may be assembled by one, two or three persons.

The shelters and shelter systems disclosed herein are modular. In certain aspects, the shelters disclosed herein may be connected to an adjacent shelter structure. In certain embodiments, one or more of the wall panels that comprise the wall may comprise an expandable connector. In certain embodiments, the expandable connector is configured to releasably connect the shelter to adjacent shelters. In certain embodiments, the expandable connecter further comprises a rigid floor panel (e.g., such that the assembled expandable connector and rigid floor panel form a hallway or corridor between two shelters). In certain embodiments, the expandable connector is thermally insulated.

Also disclosed herein are kits that comprise the shelter systems of the present inventions and assembly instructions.

In certain embodiments, the plurality of floor panels may be thermally insulated by affixing a composite insulated floor mat on the assembled floor of the shelter. For example, such a composite insulated floor mat may comprise both a reflective insulation layer (e.g., a radiant barrier or film) and one or more conductive insulation layers (e.g., foam insulation). In certain aspects, the composite insulated floor mat may comprise a radiant barrier core, onto which is disposed one or more high density e-glass filament intermediate layers and one or more scrim outer layers. In some embodiments, such a composite insulated floor mat may be affixed to the floor of the shelter using a hook and loop system (e.g., a hook and loop system located around the perimeter of the assembled floor of the shelter).

In some embodiments, one or more of the plurality of floor panels and/or the plurality of wall panels of the shelter may comprise a composite insulating material (e.g., a composite insulating material comprising one or more reflective insulation layers and one or more conductive insulation layers). For example, such a composite insulating material may comprises a radiant barrier core, onto which is disposed one or more conductive insulating intermediate layers and one or more rigid exterior layers. In certain aspects, the radiant barrier core comprises a bi-directional radiant barrier.

In certain aspects, the roof of the shelter may be insulated. Accordingly, also disclosed herein are roof structures that comprise a composite insulating material (e.g., a composite insulating material comprising both radiant and conductive insulation layers). For example, the roof structure may comprise a composite insulating material comprising a radiant barrier, onto which may be disposed one or more conductive insulating layers and a weather-resistant exterior layer. An exemplary weather-resistant exterior layer may comprise a 600 denier coated polyester fabric material in some embodiments.

In some embodiments, the shelters and shelter systems disclosed herein comprise an insulated ceiling structure. Such an insulated ceiling may also comprise a composite insulating material, for example, a composite insulating material that comprises a radiant barrier, onto which is disposed one or more conductive insulating layers. The insulated ceiling structure may be affixed to one or more of the plurality of rafters that form the roof of the shelter, thereby forming a sealed space between such insulated ceiling and the roof of the shelter.

Also disclosed herein are composite insulating materials that may comprise both reflective insulating layers and conductive insulating layers. For example, in certain embodiments, such composite insulating materials may comprise a radiant barrier film core, one or more conductive insulating intermediate layers and one or more rigid exterior layers. Advantageously, the use of such materials is not limited to the shelters and shelter systems disclosed herein. Rather, such composite insulating materials may be used to construct any number of structures. In some embodiments, the composite insulating materials disclosed herein comprise a bidirectional radiant barrier (e.g., a bidirectional radiant barrier core). In certain embodiments, the composite insulating materials disclosed herein comprise a reflective insulating material (e.g., a radiant barrier film) that comprises a first surface and a second surface, and a conductive insulating intermediate layer that is disposed on each of the first surface and the second surface. In certain aspects, the conductive insulating intermediate layer comprises an outer surface, wherein the rigid exterior layer is disposed on the outer surface.

In some embodiments, the conductive insulating intermediate layer comprises foam insulation. In some embodiments, the rigid exterior layer comprises plastic. In some aspects, the rigid exterior layer comprises polycarbonate-ABS. In certain embodiments, the width of the composite insulating material is less than about 50 mm, 45 mm, 40 mm, 35 mm, 30 mm, 25 mm, 24 mm, 23 mm, 22 mm, 21 mm, 20 mm or less.

The above discussed and many other features and attendant advantages of the present invention will become better understood by reference to the following detailed description of the invention when taken in conjunction with the accompanying examples.

BRIEF DESCRIPTION OF THE DRAWINGS

The patent or application file contains at least one drawing executed in color. Copies of this patent or patent application publication with color drawings will be provided by the Office upon request and payment of the necessary fee.

FIG. 2A illustrates the assembly of the floor using the plurality of rigid floor panels (20) and further depicts a plurality of adjustable footings (21) coupled to the underside of such rigid floor panels (20). FIG. 2B illustrates two rigid wall panels (22) being releasably coupled to the assembled floor (23) of the shelter and, as depicted, one such wall panel comprises a door (24). FIG. 2C illustrates the assembled walls (25) and roof support structure (26) of the shelter; as shown the roof support structure (26) is formed using a plurality of rafters (27) which are coupled to the top end of the assembled walls. FIG. 2D depicts the assembled or deployed shelter, the roof of which is formed by coupling a vented fabric roof (28) to the underlying roof support structure (26), and onto which a shade fly (29) is being attached.

As illustrated in FIG. 3, the assembled shelter comprises a tough, rigid floor that is formed by the shelter's crate and further comprises adjustable footings (21) to elevate the assembled shelter off of the ground. The walls (30) of the depicted shelter are formed by tough, rigid and lightweight insulated wall panels (22), one of which comprises a lockable door (24). The shelter depicted in FIG. 3 also comprises a vented fabric roof (28) and a solar shade fly (29).

FIG. 4A illustrates a rafter (27) that forms part of the roof support structure and which comprises a rafter supporting member (40) attached to a first end of such rafter. FIG. 4B depicts the rafter supporting member (40) that is positioned to be releasably coupled to a rigid top cap (41) of the shelter. FIG. 4C shows the rafter supporting member (40) of the rafter (27) coupled to the rigid top cap (41). FIG. 4D illustrates the assembled roof support structure (60) formed by a plurality of rafters (27).

As illustrated in FIG. 5A, the expandable connector (50) is depicted in its collapsed state. FIG. 5B shows the expandable connector (50) in an expanded configuration and which may be used to connect the depicted shelters to one another, as shown in FIG. 5C (CON).

As illustrated in FIG. 6A, the components of the shelter system are stowed or otherwise packaged inside of the container (10) formed by one or more rigid floor panels (20), to which adjustable footings (21) are releasably attached. FIG. 6B illustrates the assembly of the shelter floor using the plurality of rigid floor panels (20) that form the container (10) of the shelter system and further illustrates the assembly of the wall panels (22) to form the wall (25) of the assembled shelter. FIG. 6C depicts the instructions for coupling the rigid top caps (41) to the top end of the rigid wall panels (22) and the installation of the rafters (27) to form a roof support structure (26). FIG. 6D illustrates the assembly of the roof of the shelter, which is formed by releasably coupling the roof structure (60) to the roof support structure (26). The assembled shelter may be disassembled by following the assembly instructions in reverse order.

FIG. 7A illustrates an exemplary extrusion (70) with pliable fins (71) integrated into a wall panel (22). FIG. 7B depicts an extrusion (70) releasably coupled to a thermoformed tongue molded into the side of a wall panel (22). FIG. 7C illustrates an integrated extrusion (70) that is used to releasably couple two adjacent panels to each other using a tongue and groove panel joint. FIG. 7D illustrates an exemplary extrusion (70) with pliable fins (71) that is integrated into a floor panel (20) and releasably coupled to the bottom end of the wall panel (22) by mating with the tongue of the bottom end of the wall panel (22).

FIG. 8A illustrates an exemplary corner extrusion (70) with pliable fins (71). FIG. 8B depicts a corner extrusion with pliable fins (71) releasably coupled to a second extrusion (70). FIG. 8C illustrates the integrated extrusion (70) forming a corner using two adjacent wall panels (22) that are releasably coupled to each other at a ninety degree angle.

As illustrated in FIG. 14A, the plurality rafters (27) are assembled to form the roof support structure (26). FIG. 14B depicts the roof structure (60) coupled to the roof support structure (26) to form the roof of the shelter.

DETAILED DESCRIPTION OF THE INVENTION

Conventional portable shelters take a considerable amount of time, personnel and effort to assemble and deploy, which presents particular challenges when such shelters are intended for deployment under less than ideal circumstances. Accordingly, deployment speed and simplicity represent valuable characteristics of temporary shelters and shelter systems.

The shelters and shelter systems disclosed herein are versatile and, for example, may be configured for use and deployment in virtually any conditions, climates or environments, thereby making them well-suited for deployment in response to a variety of events, such as in connection with disaster relief efforts or in active combat zones. Disclosed herein are shelters and shelter systems (e.g., temporary modular shelters) that are configured for easy shipment and straightforward assembly. In certain aspects, the shelters and shelter systems described herein may be quickly and easily assembled without the use of special tools or skilled labor, making them particularly well-suited for use in connection with, for example disaster relief efforts, where special tooling may not be readily accessible.

Figure 1:
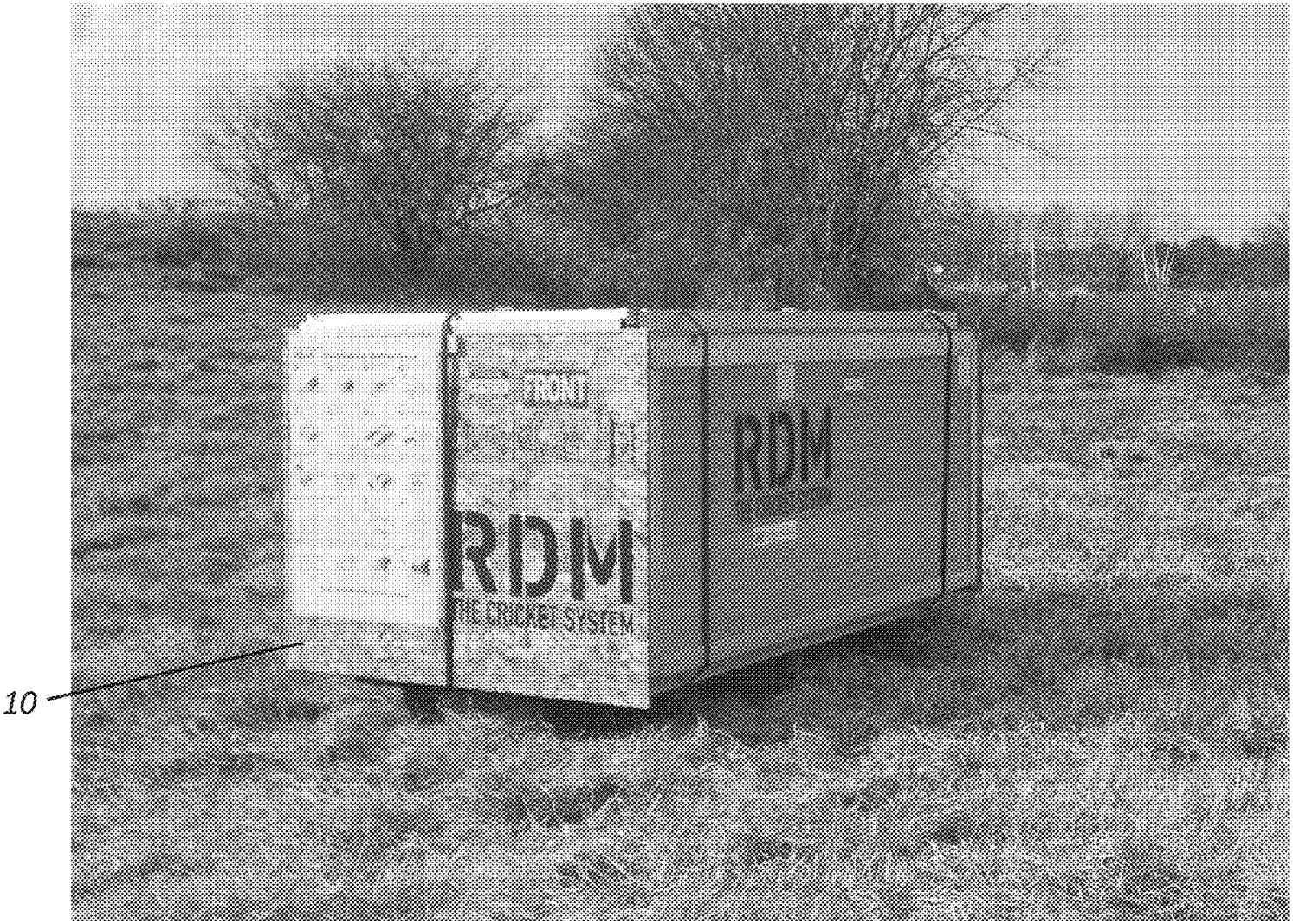
FIG. 1 depicts an embodiment of the shelter system in its stowed configuration. The container (10) shown in FIG. 1 houses all of the components of the shelter system and is formed by a plurality of rigid floor panels, several of which are interconnected.

The assembled shelters disclosed herein are durable and are able to withstand exposure to harsh environmental conditions and terrains yet, in certain embodiments are specifically configured for temporary use, following which such shelters may be easily disassembled and redeployed, as needed. As depicted in FIG. 1, the shelter systems disclosed herein are configurable into a stowed configuration, making them well-suited for shipment. In certain embodiments, the shelters disclosed herein may be disassembled (e.g., disassembled without the use of tools or other specialized equipment). For example, when use of the shelter is no longer required, such shelters may be easily disassembled, the components of the shelter stowed in a secure container structure such as that shown in FIG. 1, and the stowed shelter may then be easily transported and/or deployed to another location.

As illustrated in FIG. 1 and in FIGS. 6A-6D, the container of the shelter system houses all of the components needed to assemble the shelter and such container is formed by a plurality of rigid floor panels, which are ultimately assembled to form the floor of the shelter. For example, as illustrated in FIGS. 2A-2D and in FIGS. 6A-6D, the components of the stowed shelter systems disclosed herein are easily assembled without the use of specialized tooling or equipment. In certain embodiments, the components of the shelter system are stowed or otherwise packaged inside of the container (e.g., a crate formed by one or more rigid floor panels) in the order of assembly of such components. Similarly, in certain embodiments, the components of the shelter system may be disassembled and packaged in reverse order of assembly of such components. For example, an assembled shelter system may be disassembled by following the assembly instructions depicted in FIGS. 6A-6D in reverse order.

Figure 2A:
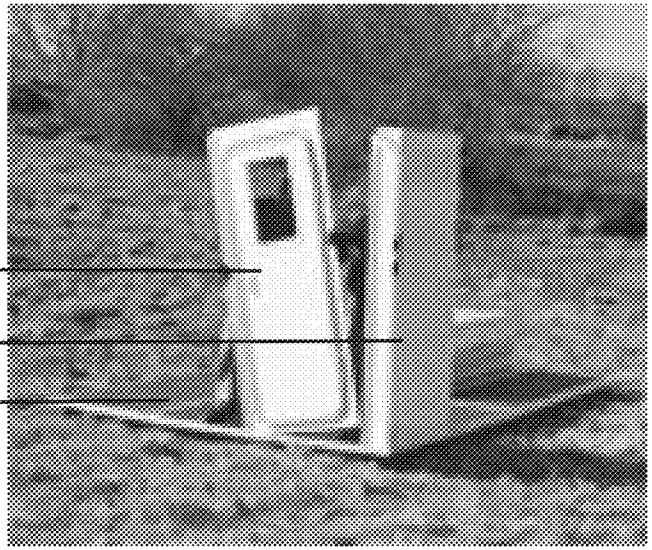
FIGS. 2A-2D depict the assembly of the components of the stowed shelter system that is shown in FIG. 1 to form a shelter.
Figure 2B:
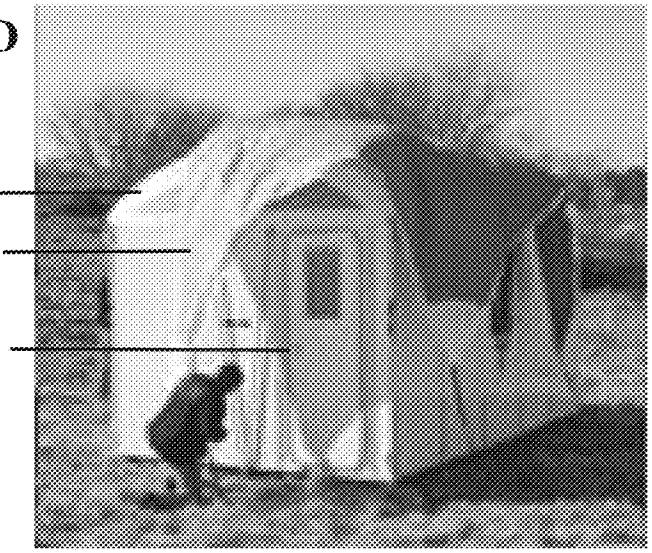

In one aspect, the shelter systems disclosed herein comprise a plurality of rigid floor panels and a plurality of rigid wall panels, each such wall panel having a top end and a bottom end substantially parallel to the top end, as depicted in FIG. 2B. The shelter systems disclosed herein may further comprise a plurality of rigid top caps, which in certain embodiments help to improve the stability of the shelter.

Figure 2C:
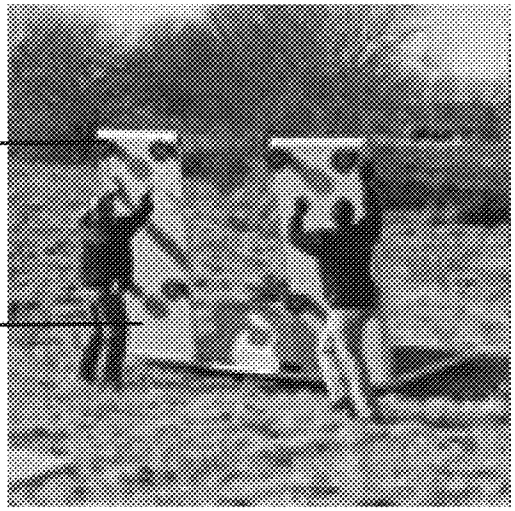
Figure 2D:
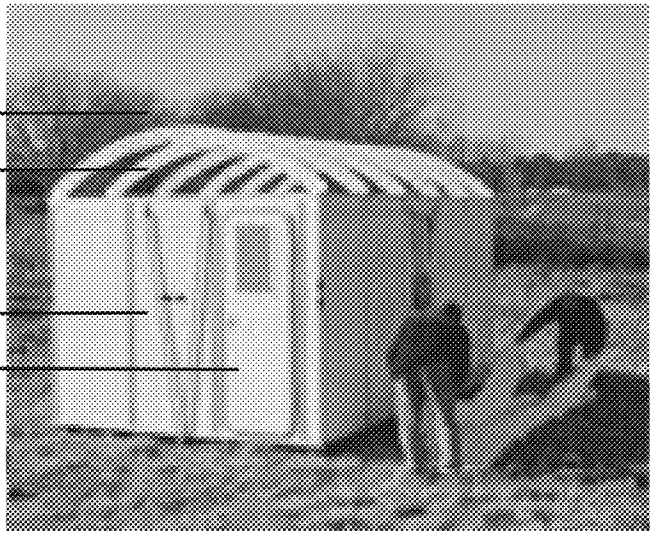
Figure 14A:
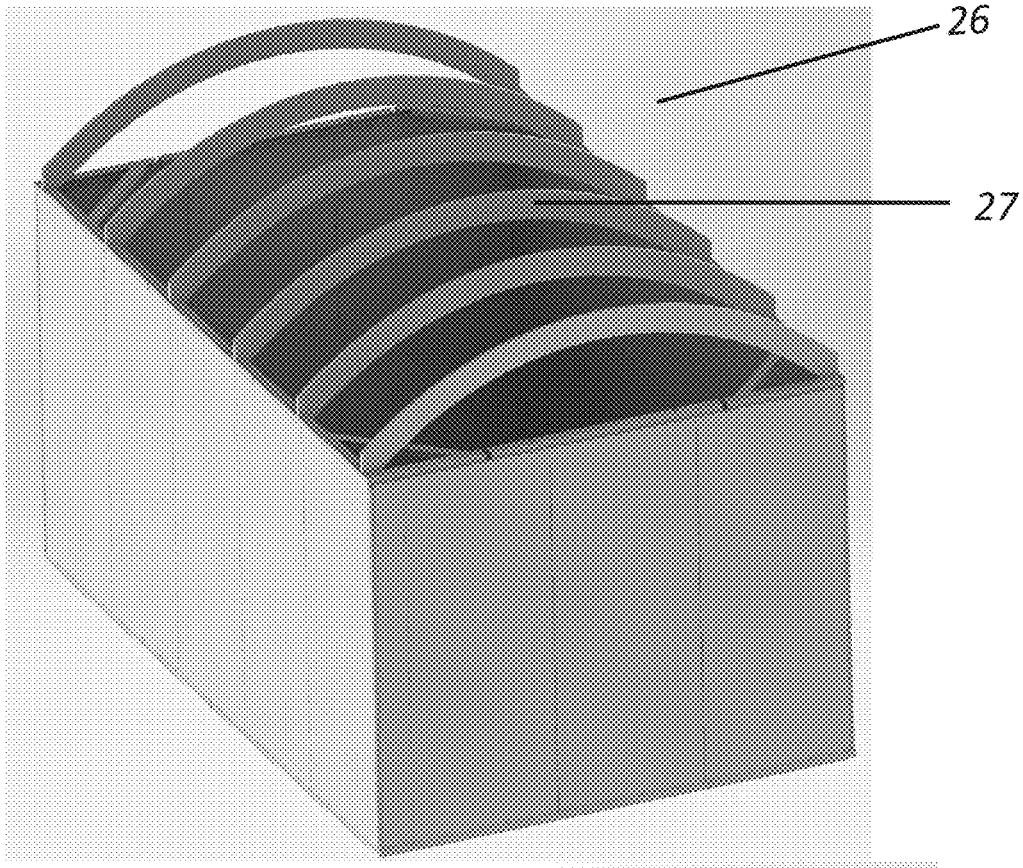
FIGS. 14A-14B depict the assembled roof of the shelter.
Figure 14B:
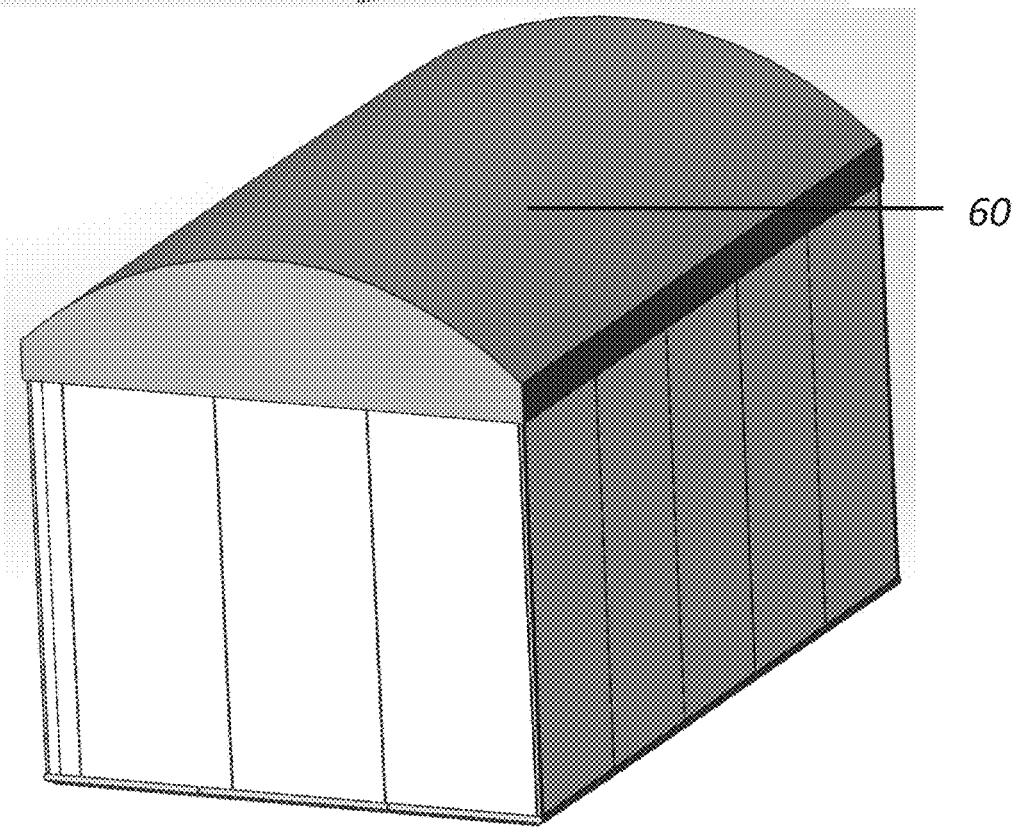

The roof of the shelters disclosed herein may be assembled using components of the shelter systems disclosed herein, such as a roof support structure (e.g., a roof support structure comprising a plurality of rafters) and a roof structure (e.g., a flexible roof structure). For example, as depicted in FIG. 2C, FIG. 6C and FIG. 14A, the roof support structure of the shelter, which is formed using a plurality of rafters, may be coupled to the top end of the assembled walls. FIG. 2D, FIG. 6D, and FIG. 14B depict the assembled or deployed shelter, the roof of which is formed by coupling (e.g., releasably coupling using snaps, hook and loop closures, or other similar means known to those of skill in the art) a vented fabric roof to the underlying roof support structure, and onto which a shade fly may be releasably attached. In those embodiments in which the roof structure is a vented fabric roof, the hems of such fabric roof may comprise one or more stiffeners to impart added strength and durability to such fabric roof, for example, in those areas in which such roof structure couples to the top end of the assembled walls. Such stiffeners also serve to distribute the load of the roof across the fabric roof and promote better seal of the fabric roof to the top end of the assembled walls. Alternatively, in certain embodiments, the roof structure of the shelters may comprise one or more rigid roof panels, which can be coupled to the roof support structures disclosed herein.

Figures 4A, 4B, 4C, 4D:
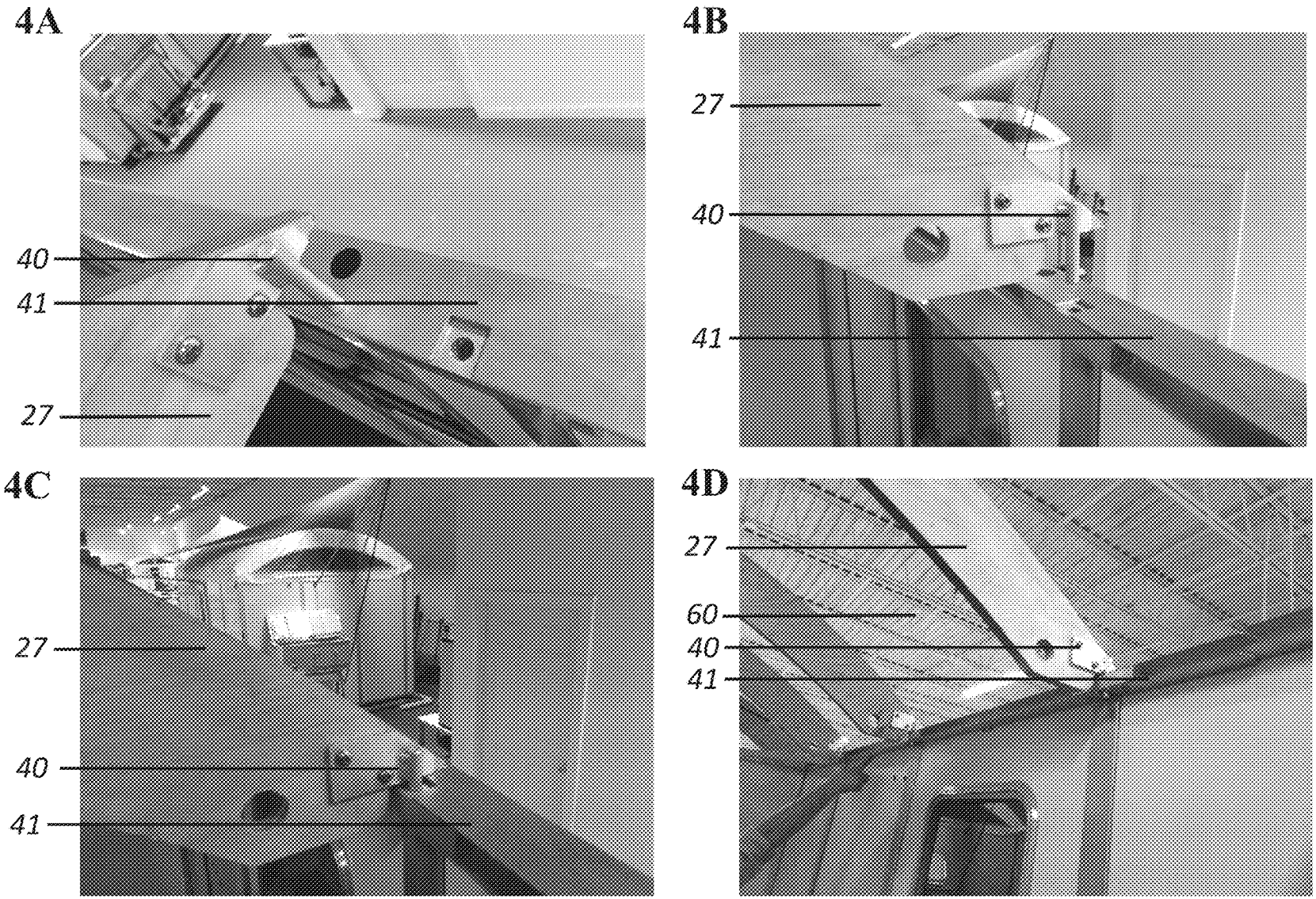
FIGS. 4A-4D depict the assembly roof support structure.

In certain aspects, the roof support structure comprises a plurality of rafters, as depicted, for example, in FIGS. 6C-6D. Such rafters may be prepared using, for example, wood, plywood, metal or thermoformed plastic. Such rafters may be flame resistant. In certain embodiments, such rafters each comprise a first end and a second end to which are coupled a rafter supporting member capable of engaging or otherwise coupling to the rigid top caps to thereby form a roof support structure comprising series of rafters and onto which the roof structure may be coupled to form the roof of the shelter. For example, as depicted in FIGS. 4A-4D and in FIG. 6C, the rigid top caps may be configured to releasably couple to the rafter supporting members to thereby define a roof support structure. As illustrated in FIG. 4C, in certain embodiments, upon coupling the rafter supporting members to the top caps, the first and second ends of the rafters do not project beyond the walls or the top caps (e.g., the first and second ends of the rafter supporting members do not extend or otherwise project beyond the outer edge of the top caps), which facilitates the securing of the rafter in its vertical position and the coupling of the roof structure to the underling roof support structure, while also promoting the formation of a weather- or watertight seal, as shown in FIGS. 14A-14B. The assembled roof support structure may be configured to releasably couple to the roof structure to thereby form a roof of the shelter. In certain embodiments, the rafters may be folding, telescopic or retractable, for example, to reduce their size and thereby improve their portability (e.g., in a stowed configuration). In those configurations where the rafters are folding, telescopic or retractable, such rafters may further comprise a stabilizing means (e.g., a lock) to stabilize the rafters and the roof support structure. In certain embodiments, the roof structure and/or the assembled roof of the shelter is thermally insulated.

Figure 6A:
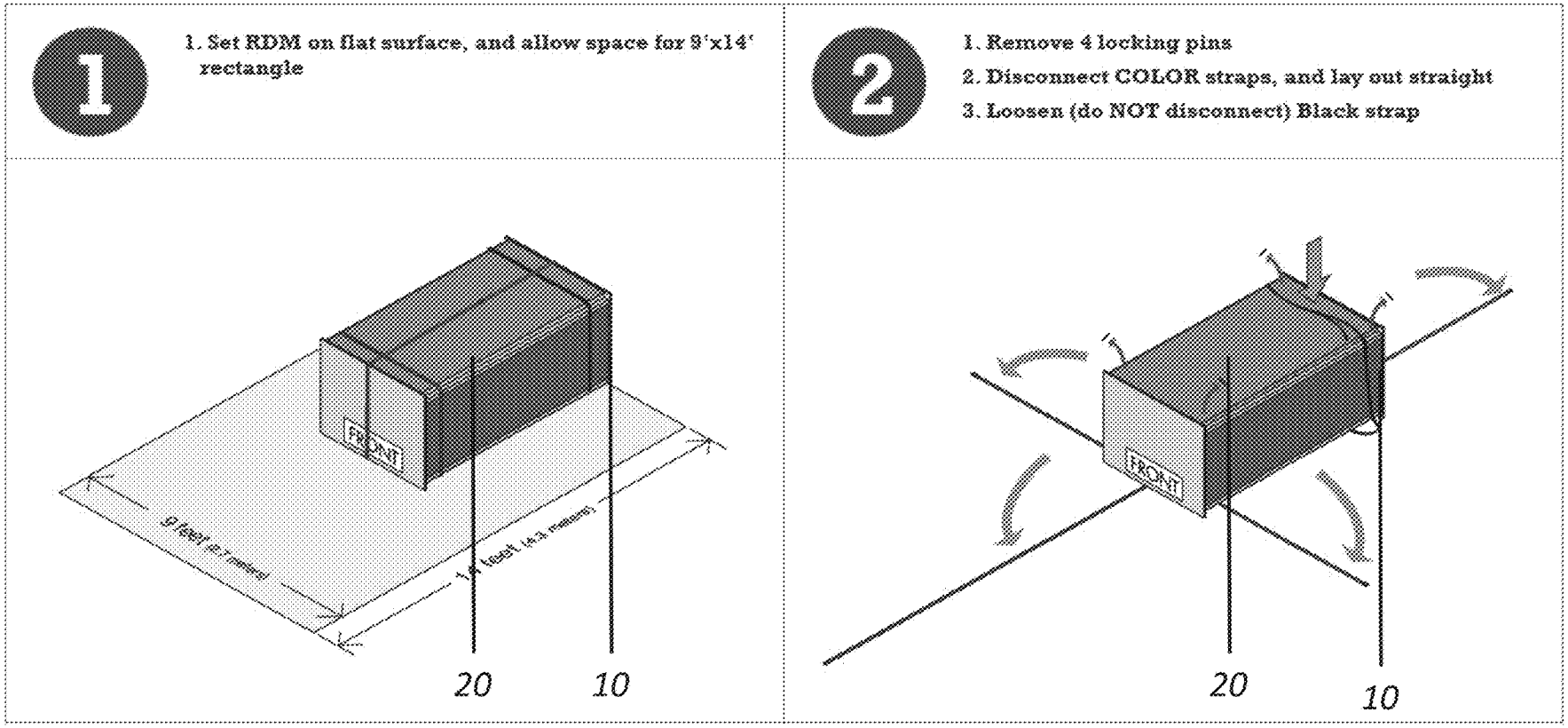
FIGS. 6A-6D depict the assembly instructions for an embodiment of the shelter systems disclosed herein.
Figure 6B:
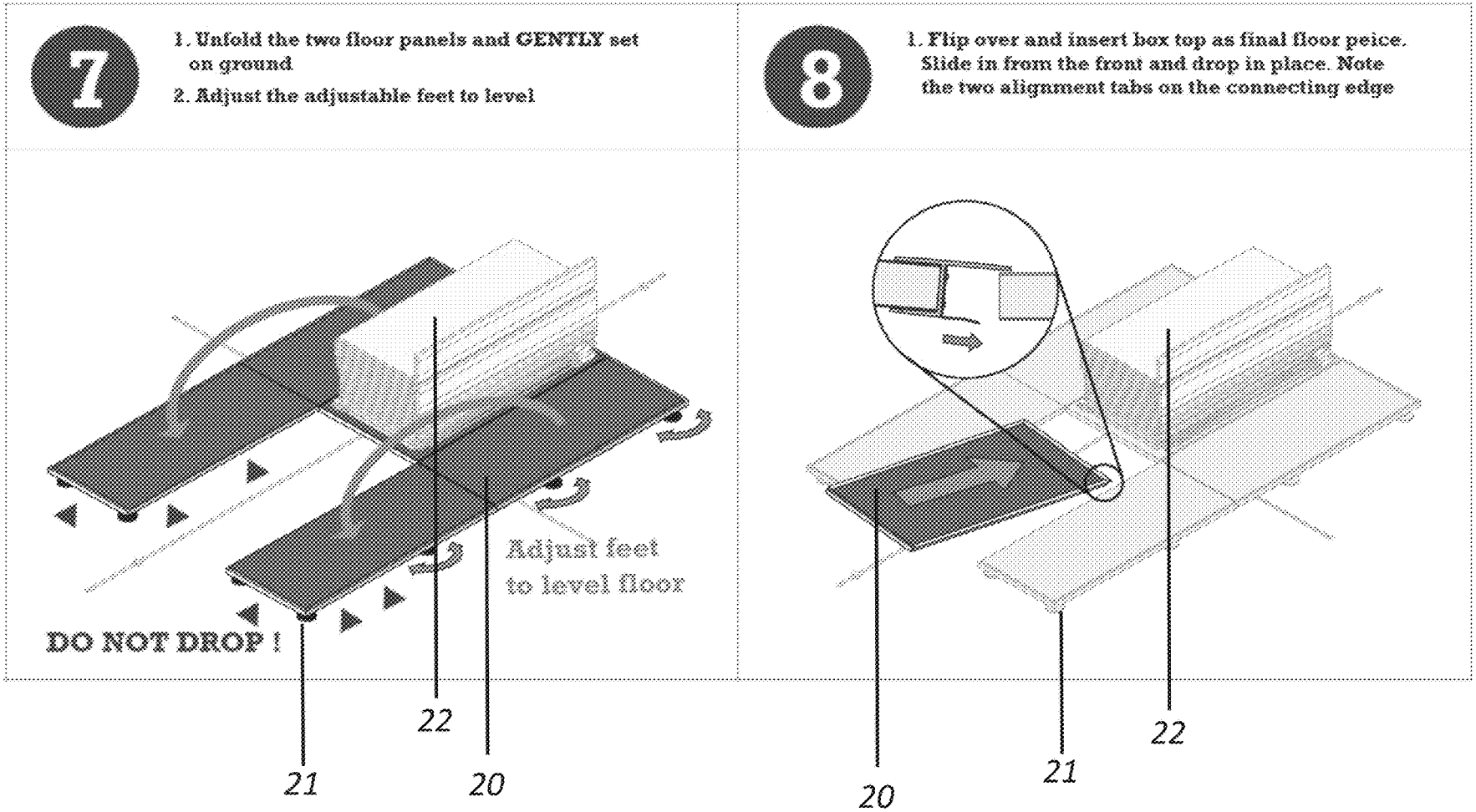
Figure 6C:
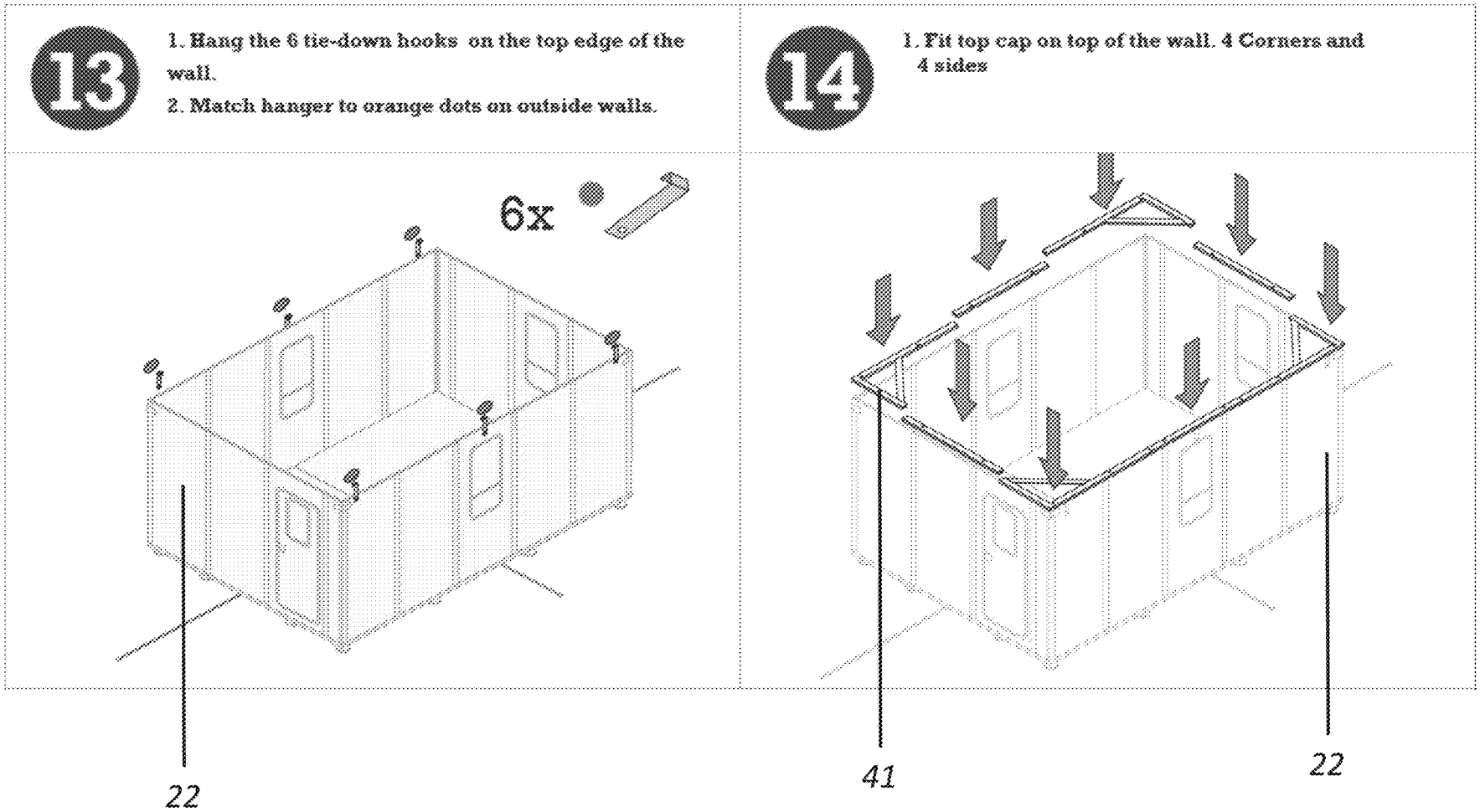
Figure 6D:
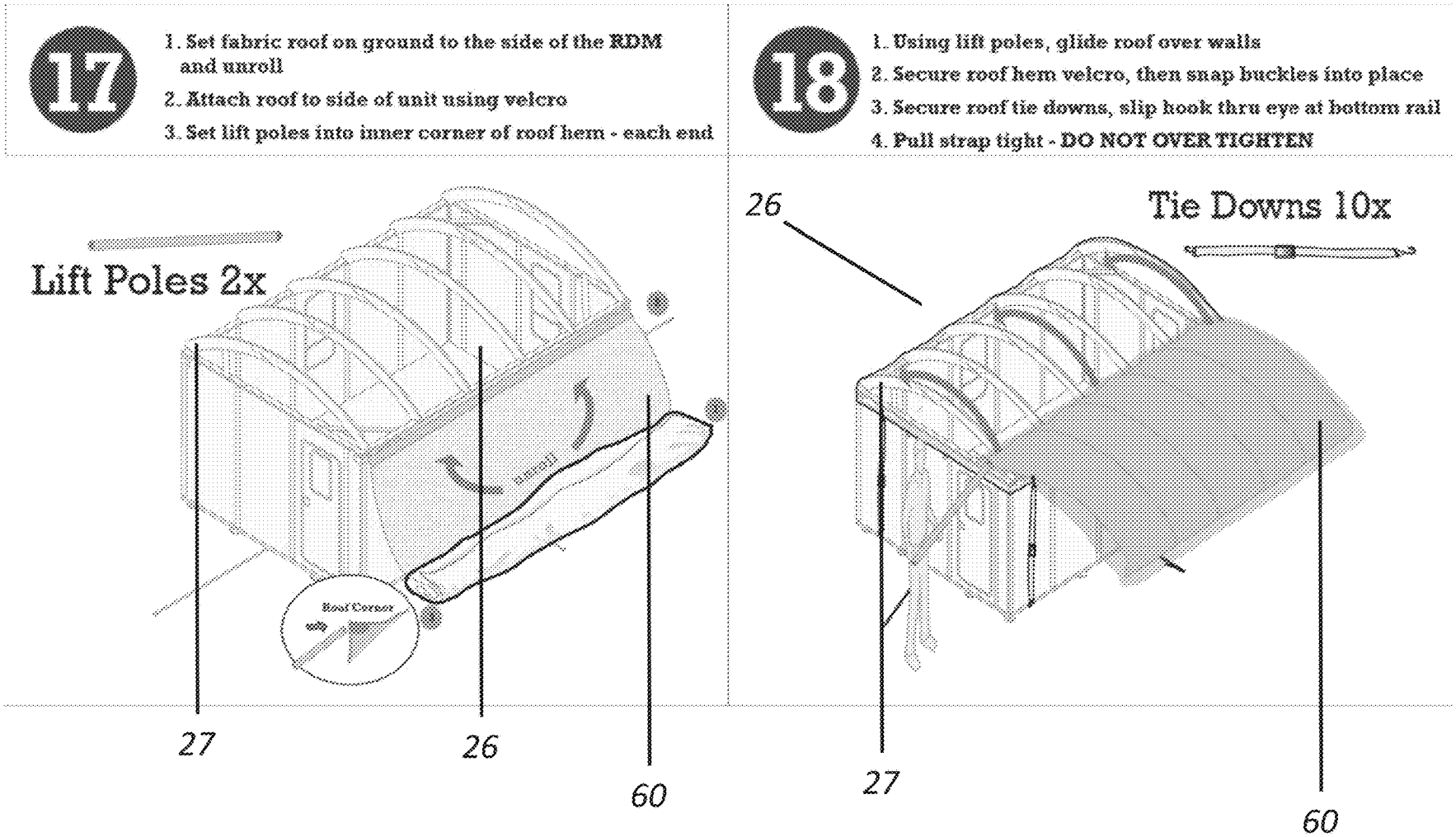

The floor of the shelters disclosed herein may be assembled using a plurality of rigid floor panels that form the container of the shelter system, for example, as illustrated in FIG. 2A and in FIGS. 6A-6B. Thus, in certain aspects, the floor of the shelter is formed by assembling one or more rigid floor panels, which may be configured or assembled into a folded state and a deployed state. In certain embodiments, one or more of the rigid floor panels are interconnected to each other. In certain embodiments, the rigid floor panels are hollow. For example, rigid floor panels may comprise or be prepared with insulated core floor or with a fully enclosed plastic panel. One or more extrusions may then be affixed to or otherwise formed on one or more edges of such floor panels, for example, to facilitate the coupling (e.g., releasably coupling) of such floor panels to one or more wall panels.

In certain embodiments, the floor panels included in the shelter systems disclosed herein serve multiple (e.g., dual) purposes. For example, as depicted in FIGS. 6A-6B, in the folded state the rigid floor panels may be assembled to form a container that is configured to securely house the components that comprise the shelter system in a stowed configuration. Conversely, in the deployed state the floor panels may be assembled to form the floor of the shelter.

In certain embodiments, one or more of such floor panels may be interconnected to each other (e.g., using a hinge), such that the container formed by such floor panels may be easily deployed to form the floor of the shelter. For example, in certain embodiments, a rigid floor panel may form a removable lid of the container while the remaining floor panels may be interconnected such that they can be easily deployed (e.g., unfolded or assembled) to form a portion of the shelter's floor. In such embodiment, the floor panel forming the lid of the shelter can be releasably coupled to the deployed (e.g., unfolded or assembled) interconnected floor panels, thereby forming the assembled floor of the shelter.

In some embodiments, the floor of the shelter (e.g., the floor formed by assembling a plurality of rigid floor panels) defines a perimeter of a shelter (e.g., a rectangular perimeter), as depicted in FIGS. 6A-6B. In some embodiments, the perimeter of the shelter comprises an extrusion configured to releasably accept or couple to the bottom end of one or more wall panels. As depicted in FIG. 2B, to construct the walls of the shelter, a plurality of wall panels are releasably coupled to the extrusion that is configured to perpendicularly and releasably couple to the bottom end of the rigid wall panels. Such extrusions may further comprise one or more spring clips that allow the wall panels to be coupled to the perimeter of the floor in a releasable manner.

Figure 7A:
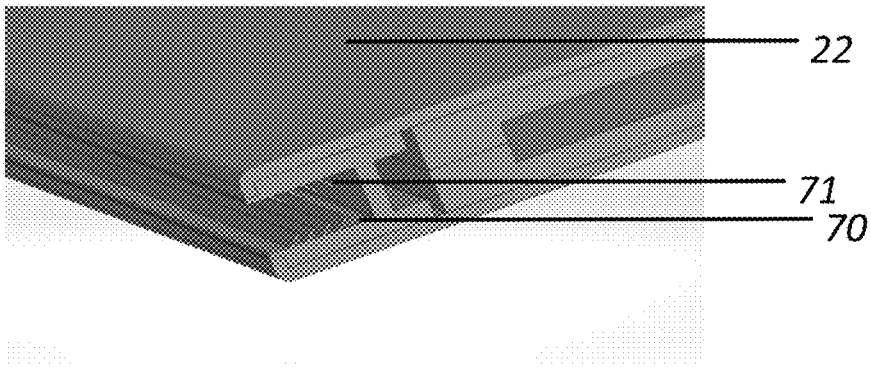
FIGS. 7A-7D illustrate an exemplary extrusion (70) that may be integrated into a wall panel (22) or floor panel (20) and used to releasably connect two adjacent wall or floor panels to each other.
Figure 7B:
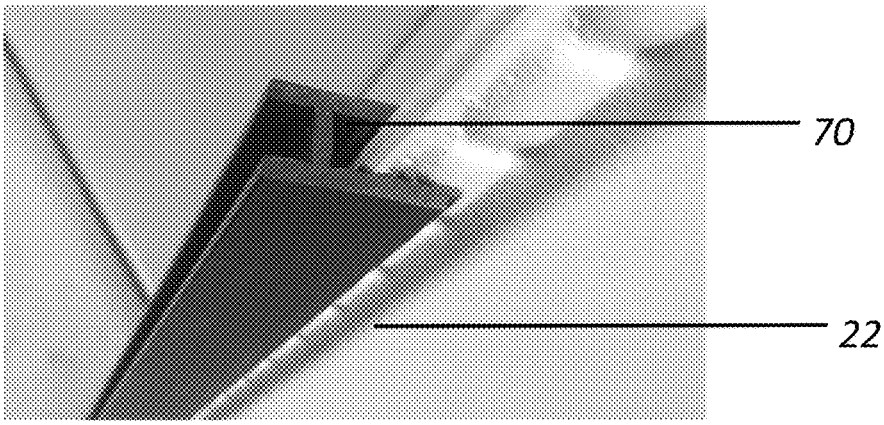
Figure 7C:
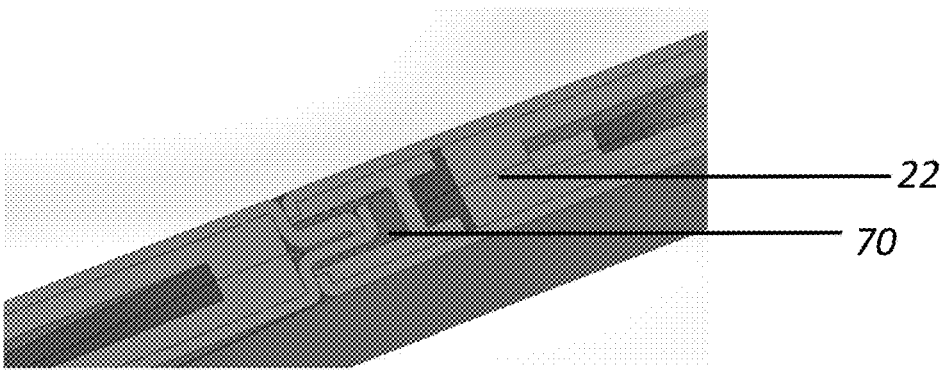
Figure 7D:
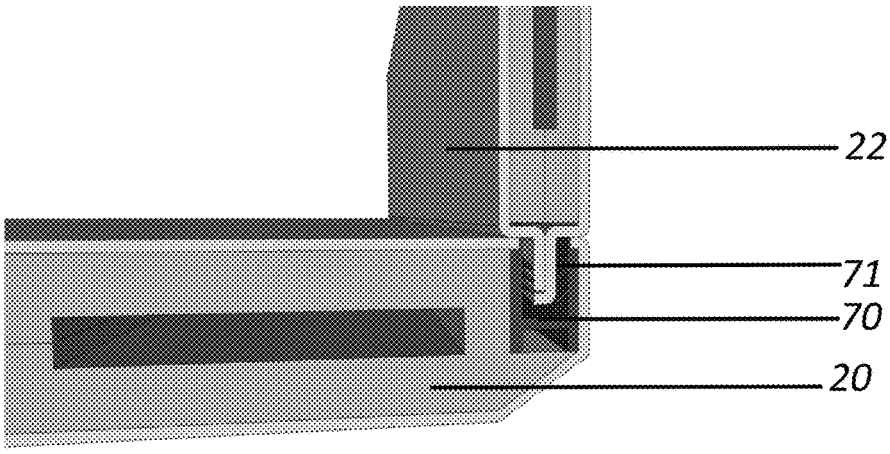

In certain aspects the extrusions may be configured as an integrated extrusion that may be used to form a joint system to couple the wall panels and/or floor panels to each other, as depicted in FIGS. 7A-7C. Such an integrated extrusion may be particularly useful in those settings in which enhanced thermal performance of the shelter is desired (e.g., in arctic or polar regions). For example, an integrated extrusion may be formed, molded or otherwise configured to mate with or otherwise engage a thermoformed tongue that may be formed on one or more sides, edges or ends of an adjacent wall panel and/or floor panel. Accordingly, in certain aspects, the side, edge or end of such a wall panel and/or floor panel may be formed as a groove that comprises or is integrated with the extrusion and that is configured to be accepted or otherwise mate with a thermoformed tongue extrusion that is formed on or in an adjacent wall panel or floor panel, as depicted in FIGS. 7B and 7C. Such integrated extrusions therefore may be connected with an adjacent wall panel and/or floor panel, thereby forming a weather- and/or air-tight seal.

Integrating the extrusions into the sides or edges of a panel (e.g., a wall and/or floor panel) advantageously lowers the profile and weight of such panel, thereby forming a seamless, weather- and/or air-tight seal with little thermal bridging. In certain aspects, the integrated extrusions are formed using the same material as the panel. In certain embodiments, the integrated extrusion may be formed of polyvinyl chloride (PVC). In yet other embodiments, the integrated extrusion may be co-extruded with pliable fins, as depicted in FIG. 7A, to improve the seal between the integrated extrusion and an adjacent panel (e.g., to form air-tight seal between two adjacent panels).

Figure 8A:
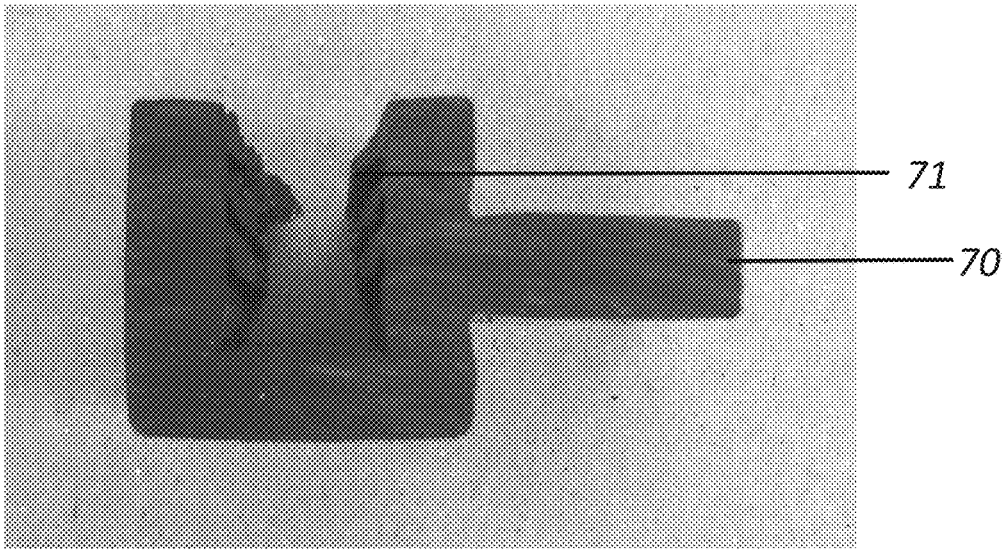
FIGS. 8A-8C depict an exemplary corner extrusion (70) that may be integrated into a wall panel (22) or a floor panel (20) and used to releasably connect two adjacent panels to each other at a ninety degree angle to form a corner of the shelter.
Figure 8B:
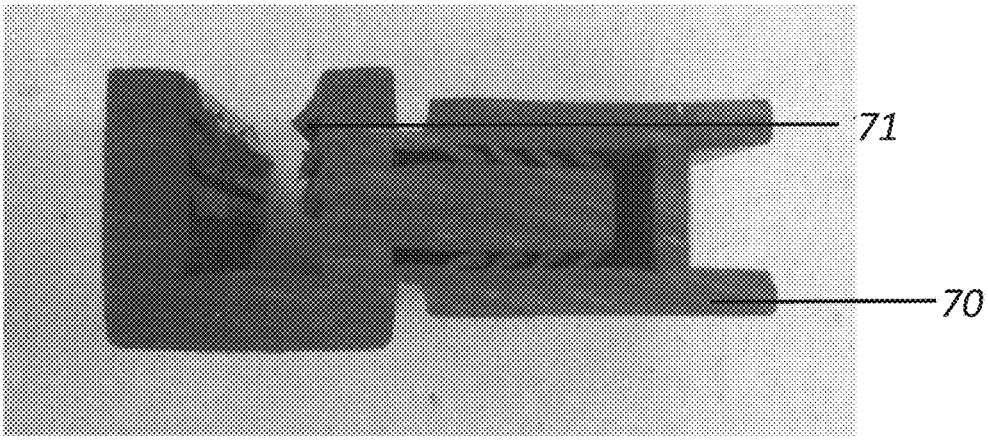
Figure 8C:
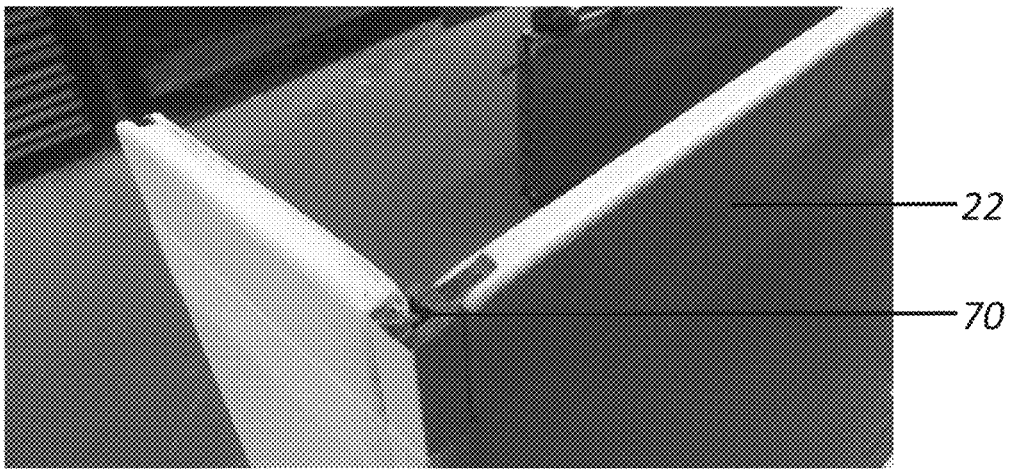

In certain aspects, the integrated extrusions disclosed herein may be configured to couple two adjacent panels to form an angle. For example, two wall panels may be connected at a ninety degree angle relative to each other, as depicted in FIGS. 8A-8C, to form the corners of the shelter system. As shown in FIGS. 8A and 8B, a corner extrusion may be formed and/or integrated in the panel and configured to be coupled to the extruded groove formed or integrated on an adjacent panel, thereby forming a ninety degree corner. FIG. 8C illustrates the integrated extrusion forming a corner using two adjacent wall panels that are releasably coupled to each other at a ninety degree angle.

It should be understood that, as used herein, the term "releasably" means that the respective members (e.g., an extrusion and one or more rigid wall panels) may be securely attached to each other and detached from each other repeatedly without damage to the members. This may be accomplished, for example, by using the extrusions which comprise spring clip connections or with use of the rigid top caps disclosed herein, as shown in FIGS. 4A-D. Similarly, in certain embodiments the respective members may be securely attached to each other and subsequently detached from each other (e.g., by using the extrusions which comprise spring clip connections or with use of the rigid top caps disclosed herein) repeatedly without the use of tools. In certain embodiments, once the walls of the shelter have been assembled (e.g., by releasably coupling a plurality of wall panels to extrusions located on the perimeter of the floor), such walls may be further stabilized or braced using, for example, a plurality of rigid top caps, for example as illustrated in FIG. 6C. In certain embodiments, the top ends of the rigid wall panels are configured to releasably couple to the rigid top caps, as illustrated in FIGS. 4A-D.

In certain embodiments, the rigid wall panels are hollow. For example, rigid wall panels may comprise or be prepared with hollow core floor. In certain embodiments, one or more extrusions may be affixed to or otherwise formed on one or more edges of such wall panels, for example, to facilitate the coupling (e.g., releasably coupling) of such wall panels to one or more floor panels or to one or more top caps.

In certain embodiments, the shelters disclosed herein are modular shelters. Such shelters comprise a plurality of walls (e.g., four or more walls), each of which may further comprise a plurality of rigid wall panels having a top end and a bottom end substantially parallel to the top end. The shelters disclosed herein may further comprise a plurality of rigid top caps. In some aspects, the rigid top caps may be configured to releasably couple to the top end of the rigid wall panels and to thereby stabilize the walls of the shelter (e.g., by releasably coupling a rigid top cap to the top end of two or more adjacent wall panels).

In certain embodiments, the shelters may be thermally insulated, thereby making the shelter suitable for deployment in diverse environmental conditions. For example, in some aspects, one or more of the plurality of the floor panels may be thermally insulated. Similarly, in other aspects, one or more of the plurality of wall panels may also be thermally insulated. In certain embodiments, such floor panels and/or wall panels are insulated with radiant barrier films. In some embodiments, such radiant barrier films incorporate an air space on each side of the radiant barrier film.

In certain embodiments, the shelter systems comprise two or more walls (e.g., two, three, four, five, six or more walls). In certain embodiments, such walls may be configured to be substantially parallel to each other (e.g., the front wall may be configured to be substantially parallel to the rear wall and/or two side walls may be configured to tie substantially parallel to each other). In certain aspects, one or more of the wall panels that comprise the wall of the shelter may comprise one or more windows. In certain aspects, one or more of the wall panels that comprise the wall of the shelter may comprise one or more doors, as illustrated in FIG. 2B. Such doors or windows may be incorporated into the molds that are used to form the wall panels.

Figures 5A, 5B:
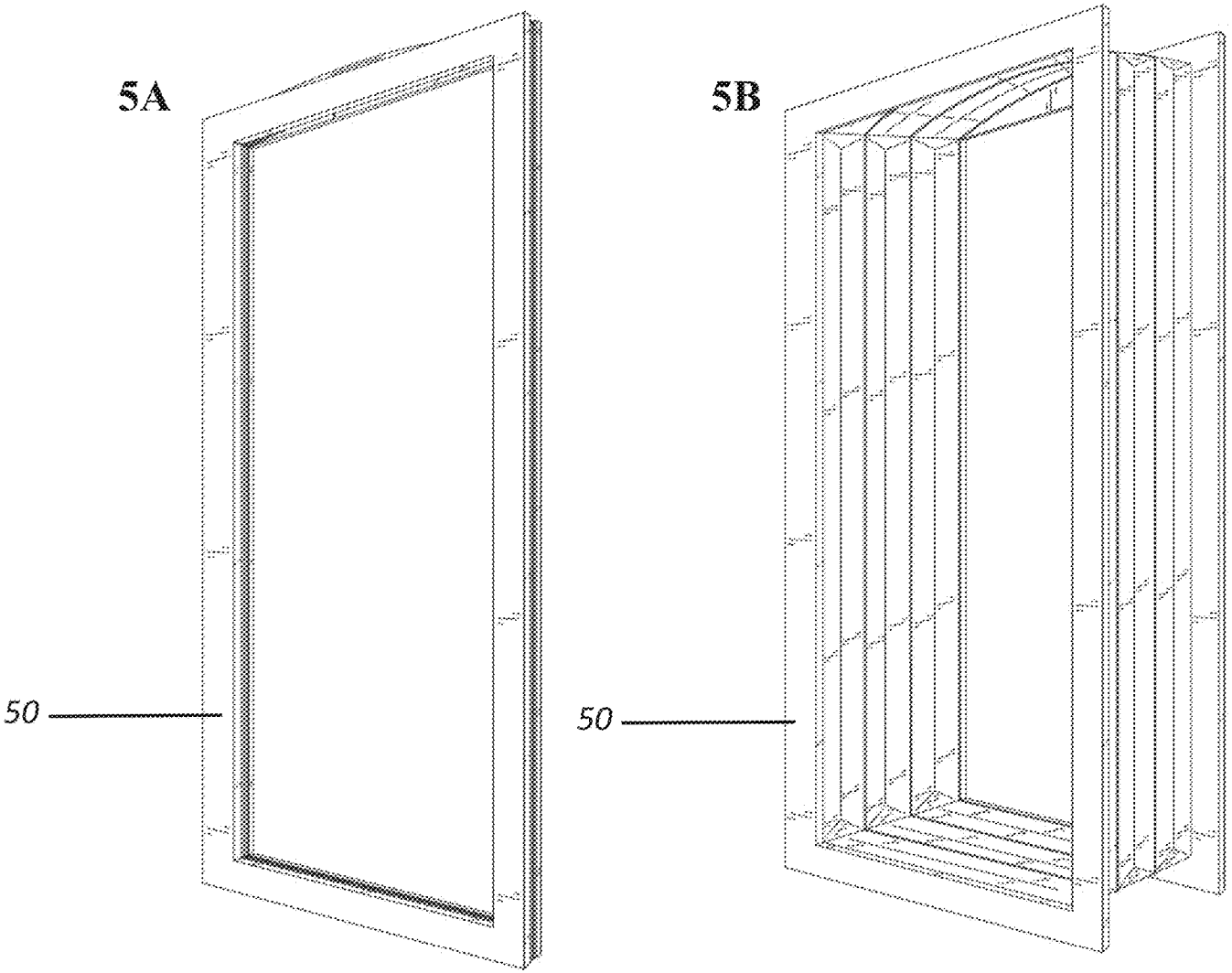
FIGS. 5A-5C depict an expandable connector (50) in both the collapsed and expanded configurations and that may be used in place of a rigid wall panel to form a hallway or corridor to join an assembled shelter to an adjacent shelter.
Figure 5C:
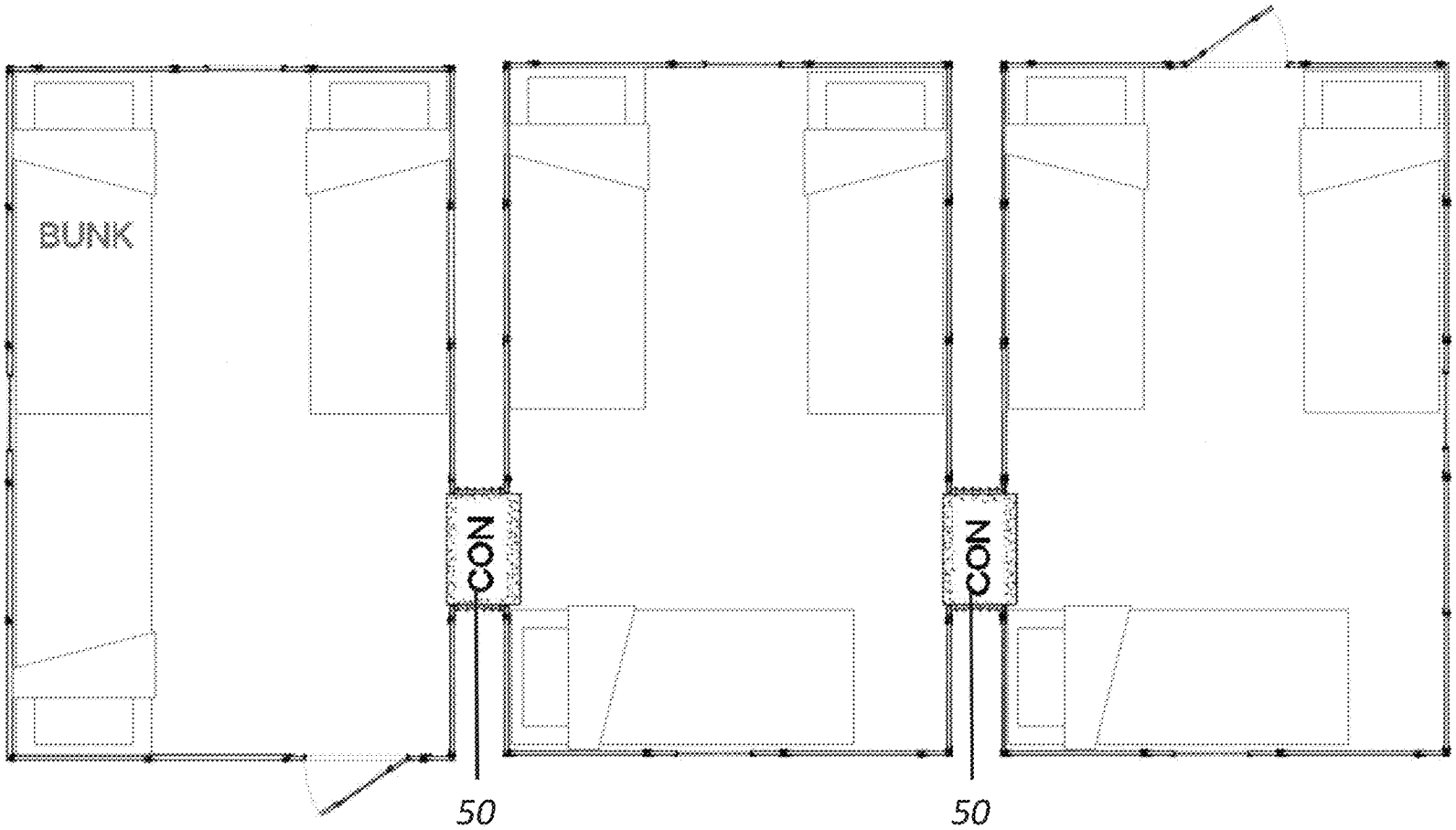

One aspect of the shelters and shelter systems disclosed herein is that two or more assembled or deployed shelters may be releasably coupled to each other in any desired combination or configuration. Accordingly, in some embodiments, the shelters and shelter systems disclosed herein are modular. In some aspects, one or more of the wall panels that comprise the wall of the shelter may comprise one or more expandable connectors that may be configured to releasably connect one shelter structure to an adjacent shelter structure, thereby allowing multiple configurations of such modular shelter systems. For example, in some embodiments, a first shelter (e.g., a base unit) may be releasably connected to a second, third, fourth, fifth, sixth, seventh, eighth, ninth, tenth or more shelter (e.g., a shower unit, latrine unit, a second base unit), thereby forming a complete living unit. Similarly, a series of assembled shelters (e.g., two, three, four, five, six, seven, eight, nine, ten or more assembled shelters) may be deployed and connected together to form a desired combination so that, by way of example, one shelter may serve as a living quarter and be releasably coupled to an adjacent shelter that is configured as a kitchen, mess hall or a latrine. In certain embodiments, a single wall panel may comprise an expandable connector. Alternatively, in those embodiments where, for example, a wider connection between two shelters is necessary (e.g., to facilitate passage of a gurney between two adjacent shelters), two or more wall adjacent panels may comprise an expandable connector (e.g., two, three, four or more adjacent wall panels that comprise the assembled wall of the shelter may comprise an expandable connector). In certain embodiments, the expandable connectors may further comprise a rigid floor panel to thereby form a hallway or corridor that connects two shelters to one another, for example, as depicted in FIGS. 5A-5C. In certain embodiments, the expandable connector is thermally insulated.

The shelters and shelter systems disclosed herein may further comprise means to secure the shelter and its contents. For example, in those embodiments where the shelter comprises a door or a window, one or more of such doors and windows may comprise a lock.

The shelters and shelter systems disclosed herein are configured to be raised off of the ground in an assembled or deployed configuration, thereby keeping the floor of the shelter away from insects, vermin and minor flooding. In such embodiments, the underside of the rigid floor panels may comprise one or more footings or supporting members, for example as illustrated in FIG. 2A and in FIG. 6A, that serve to elevate the shelter structure off of the ground. In certain embodiments, such footings are adjustable and accordingly may be used to customize the height of the shelter. In certain embodiments, such adjustable footings provide a means of leveling the shelter if the ground onto which it is placed is not entirely flat. In other embodiments, such footings are attached to the floor panels that form the container of the shelter in its stowed configuration and serve to hold such container off of the ground, for example, to facilitate shipment and/or storage of such container (e.g., in lieu of affixing a standard shipping pallet to the underside of such container, one or more footings may be attached to the floor panels forming the underside of such container).

Figure 3:
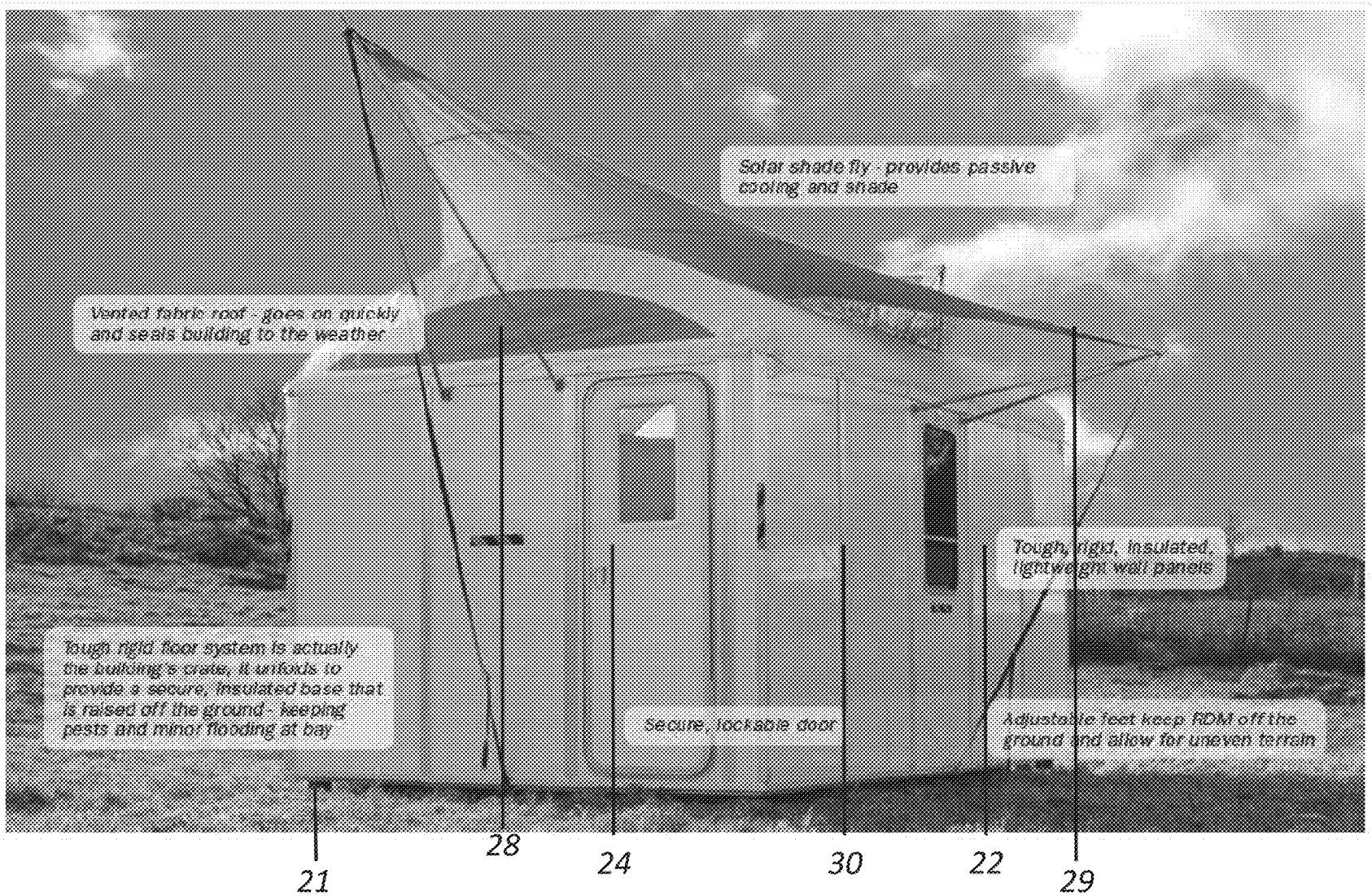
FIG. 3 depicts the assembled or deployed shelter shown in FIG. 1 and FIGS. 2A-2D.

In certain embodiments, the assembled roof of the shelter stabilizes the shelter (e.g., stabilizes the walls of the shelter). As shown in FIG. 3, in certain embodiments, the roof of the shelter is curved or barrel-shaped, which advantageously facilitates the elimination of precipitation from the interior of the shelter. The shelters and shelter systems disclosed herein may also comprise one or more cam straps to further stabilize the assembled shelters or the components of the shelter system. For example, one or more cam straps may be used to secure the roof to the walls of the shelter.

As shown in FIG. 2D and FIG. 3, the shelters and shelter systems disclosed herein may further comprise a shade fly, which may be affixed to the roof of the shelter. In certain embodiments, the shade fly is a solar shade fly and provides passive cooling and shade to the shelter.

In certain embodiments, the shelters disclosed herein may further comprise one or more ground anchors.

The shelters disclosed herein are characterized by the ease with which they can be assembled and disassembled. In certain aspects, the shelters disclosed herein may be assembled or disassembled without tools. In certain embodiments, the shelter systems disclosed herein may be configured as a kit, which further comprises assembly instructions (e.g., instructions that graphically depict the assembly of the shelter, as shown in FIGS. 6A-6D). In certain embodiments, such assembly instructions may be followed in reverse order to disassemble the assembled shelter system.

The shelters and shelter systems disclosed herein may be configured for deployment in any environments or climates. For example, as discussed above, such shelters and shelter systems may be configured with a shade fly to provide passive cooling to an assembled shelter that is intended for deployment in a desert or tropical climate. Conversely, in certain aspects the shelters and shelter systems disclosed herein may be configured for deployment in cold or arctic environments or climates. For example, one or more components of such shelters and shelter systems (e.g., a floor panel, a wall panel and/or the roof structure) may be insulated to retain heat in the assembled shelter or to minimize heat loss.

The shelters and the components thereof may be insulated with any number of materials, which in certain embodiments, may include radiant films or barriers, conductive insulation barriers or materials and any combinations thereof. For example, in certain aspects, the shelters and any components thereof may be insulated using a composite insulating material that comprises a reflective insulating material (e.g., a radiant film or barrier), onto which may be disposed or otherwise layered a conductive insulating material (e.g., one or more foam conductive insulation barriers or layers). The use of such composite insulating materials provides a means of improving the thermal performance of the shelter system and its components, for example, relative to the individual reflective insulating material or the conductive insulating material. Additionally, the inclusion of both a reflective and a conductive insulating material or barrier as components of such composite insulating materials may be used to limit or eliminate physical contact with the underlying radiant film or barrier and, as a result, heat cannot be transferred through conduction and all heat transfer must be radiant. Accordingly, in certain aspects, the composite insulating materials disclosed herein comprise a space on each side of the reflective insulating material (e.g., a physical space or gap located between the reflective insulating material and the conductive insulating material). In certain embodiments, the reflective insulating material (e.g., radiant barriers and films) that comprise the composite insulating materials disclosed herein are up to 95% effective at reflecting radiated heat. This translates into a greatly reduced load.

As used herein, the term "load" refers to the amount of work the mechanical heating or cooling systems must do to reach and/or maintain a set interior temperature. The composite insulating materials disclosed herein trap heat within the shelter or bounce it away, thereby reducing load. For example, in certain embodiments, the composite insulating materials disclosed herein are able to reduce load by about 10%, 20%, 25%, 30%, 40%, 50%, 60%, 70%, 75%, 80%, 85%, 90%, 95%, 97%, 98%, 99% or more. When the shelters and shelter systems disclosed herein are deployed to a cold or arctic environment, the inward-facing radiant films or barriers help to trap heat in the shelter, thereby reducing load.

The composite insulating materials disclosed herein may be advantageously configured to also keep heat out of the assembled shelter by configuring such composite insulating materials such that the reflective insulating material (e.g., radiant barriers) are directed or otherwise point towards the exterior of the shelter. For example, in certain aspects, a composite insulating material may be deployed in or on the shelter or on any of its components (e.g., a wall panel, a floor panel and/or roof structure) such that the radiant barrier reflects heat outward, thereby reducing the temperature inside the assembled shelter.

Figure 9:
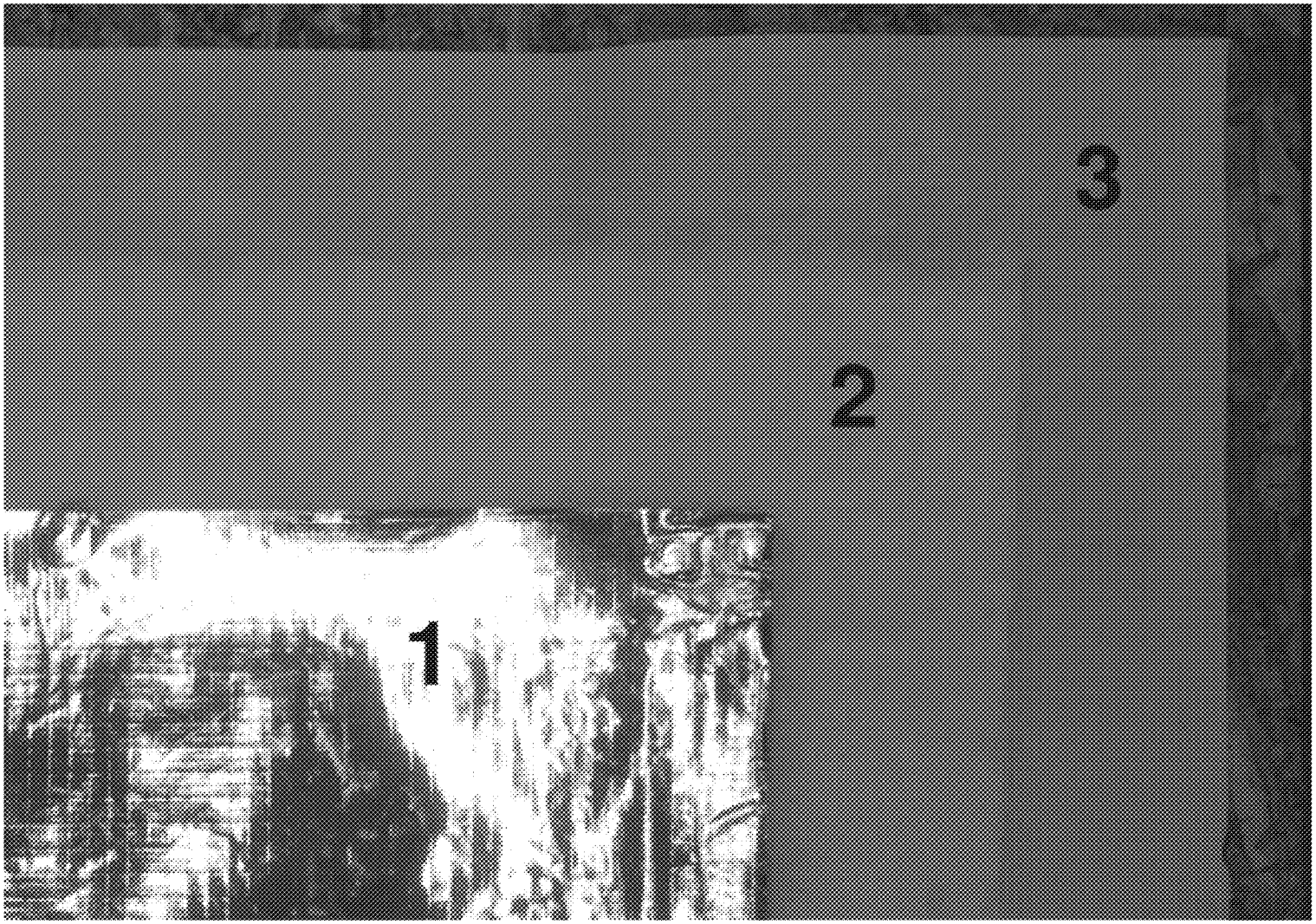
FIG. 9 depicts an exemplary insulated roof structure (60) which is a three-layer composite consisting of a downward-facing reflective insulating material (1), over a layer of conductive insulation (2), which is over a heavy duty weather resistant exterior layer (3).
Figure 10:
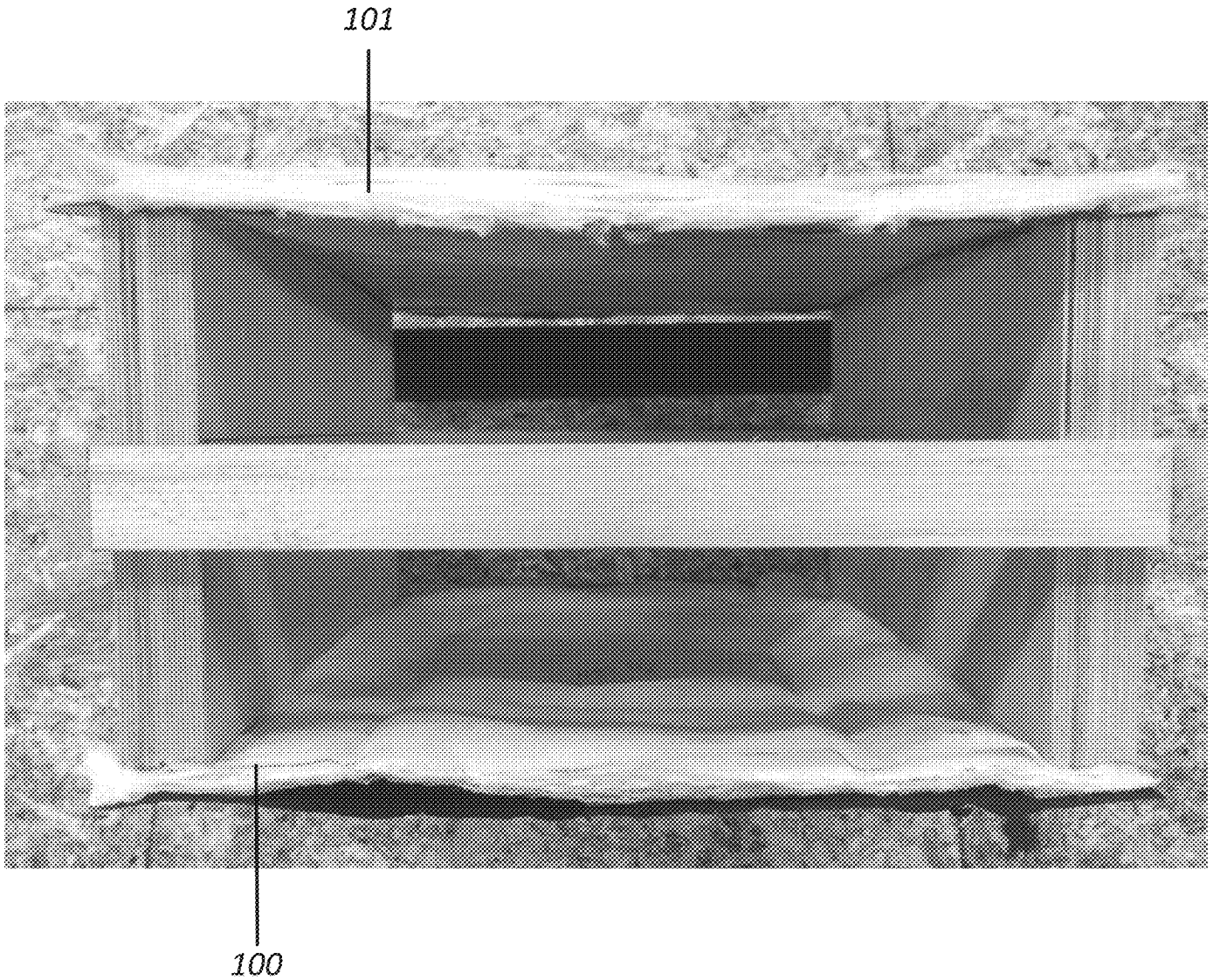
FIG. 10 depicts the relationship between the insulating radiant barrier of the insulated ceiling (100) and the insulating radiant barrier roof structure (101). The air space between the rafters provides a sealed space between the two insulating components, thereby increasing the overall thermal performance of the assembled shelter system.
Figure 11:
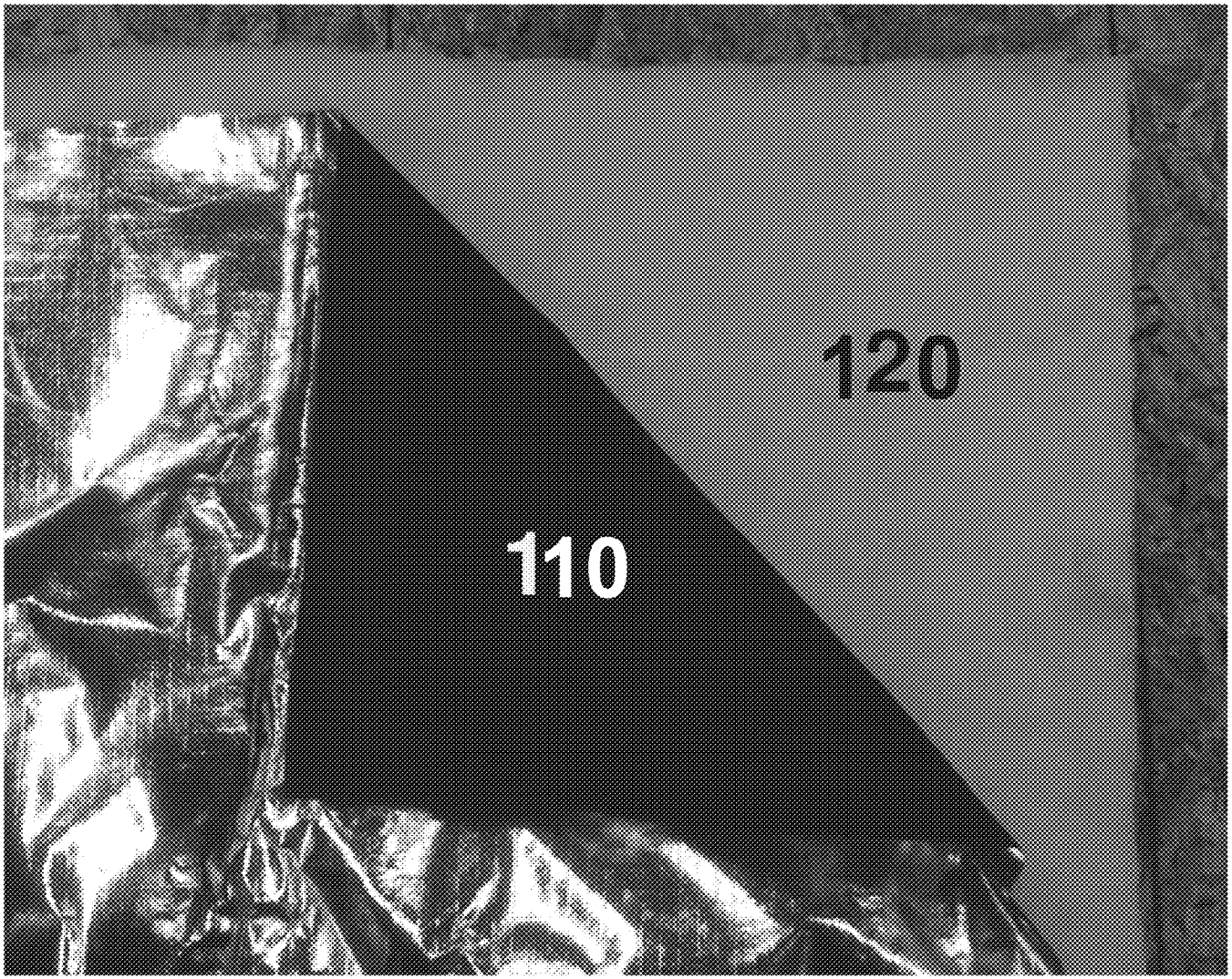
FIG. 11 depicts an exemplary insulated ceiling which is a two-layer composite consisting of a downward-facing radiant barrier material 69 (110) over a layer of conductive insulation (2) (120). The insulated ceiling may be affixed by means of a hook and loop system to the undersides of the plywood rafters, forming an enclosed air space between the insulated ceiling and the roof of the assembled shelter, as depicted in FIG. 10.

As depicted in FIG. 9, the roof structure of the shelter system may comprise a composite insulating material. In certain embodiments, the roof or roof structure is or comprises a three-layer composite insulating material consisting of or comprising a reflective insulating material (e.g., a radiant film or barrier), disposed onto a conductive insulating material (e.g., THINSULATE G100), and having a heavy duty, weather resistant exterior layer. Such a composite insulated roof or roof structure may be installed in the same way as the standard single-ply roof structure discussed above, but with additional tie-downs and reinforcing. The insulated roof structure completes the shelter assembly and the exterior envelope, and is part of the enclosed air space above the ceiling, as depicted in FIG. 10. As shown in FIG. 9, an exemplary insulated roof may be formed as a composite material and comprises a downward-facing thermal reflective insulating roof structure layer (e.g., a radiant barrier manufactured by Brookwood), a conductive insulation material or layer (e.g., THINSULATE G100) and an exterior 600 denier coated polyester material (Kenyon). The assembled shelter may comprise an insulated ceiling, which in certain embodiments comprises a composite insulating material, as depicted in FIG. 11. In certain embodiments, the insulated ceiling comprises a multi-layer composite material consisting of or comprising a reflective insulating material (e.g., one or more radiant films or barriers) onto which is disposed a conductive insulation material (e.g., a water-resistant insulating material, such as THINSULATE G100). Upon assembly of the shelter, the insulated ceiling may be installed from the protected interior of the assembled shelter by attaching or fixing such insulated ceiling to undersides of the rafters, forming an enclosed air space between the ceiling and the roof components, as depicted in FIG. 10. As shown in FIG. 10, the air space between the rafters provides an important sealed space between the two insulating components (e.g., the insulated roof and the insulated ceiling), thereby increasing overall thermal performance of the assembled shelter. An exemplary insulated ceiling is depicted in FIG. 1.1 and comprises a downward-facing thermal reflective layer (1) that is a metallized radiant barrier rip stop nylon cloth, onto which is disposed a conductive insulation layer (2) (e.g., THINSULATE G100). Advantageously, the insulated ceiling can be made reversible to function very well in hot climates.

In certain embodiments, the floor and/or floor panels of the shelter system may also be insulated, for example, by disposing a composite insulated floor mat on each floor panel or on the assembled floor of the shelters disclosed herein.

Figure 12:
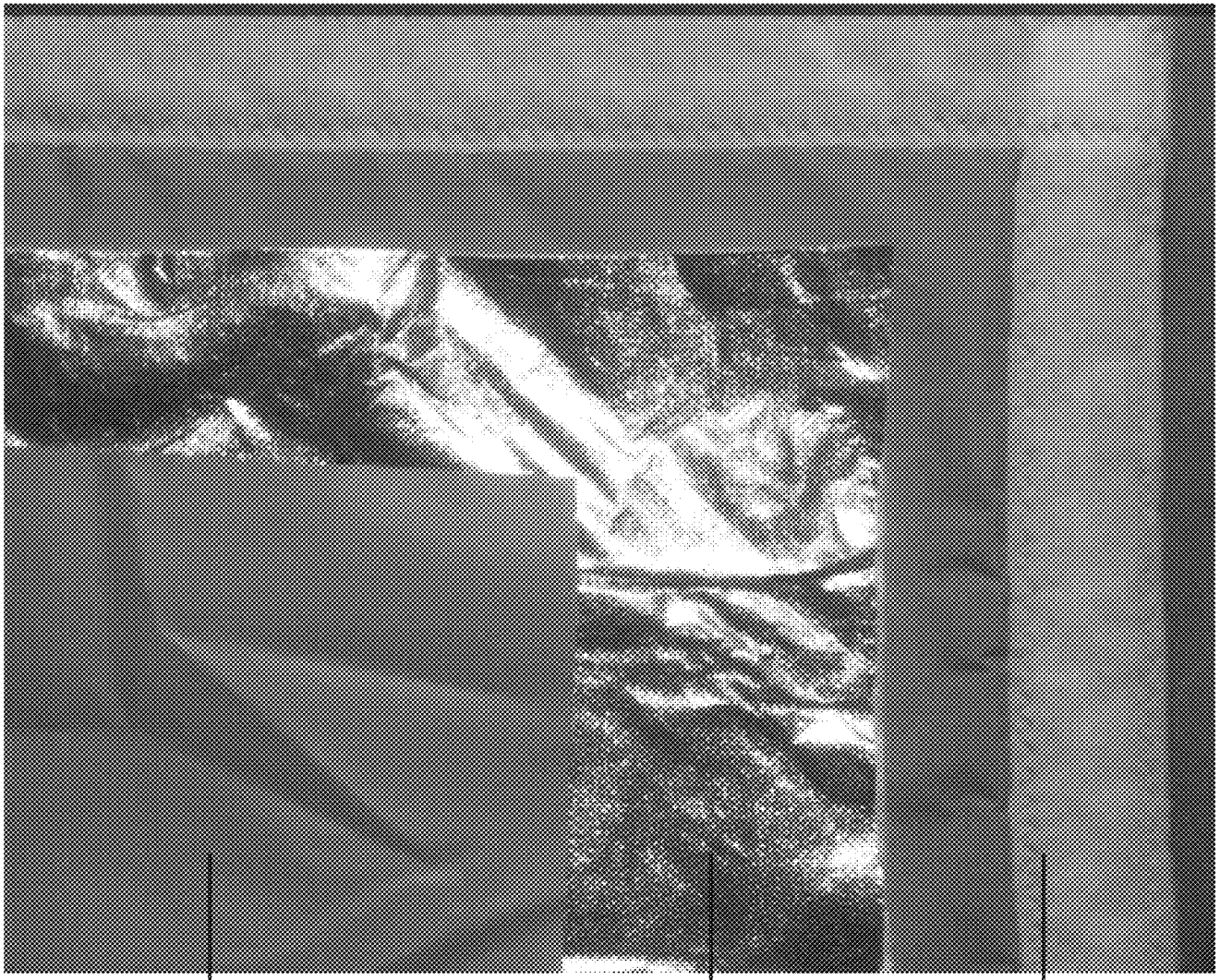
FIG. 12 depicts an exemplary insulated floor mat, which may be installed onto the floor of the assembled shelter. The insulated floor mat illustrated in FIG. 12, is a 5-ply composite material comprising a walking surface (121), an insulated core (122) comprising radiant barriers on each side of a high density e-glass filament blanket, and a scrim layer (123) to protect the downward-facing radiant barrier.

Accordingly, in certain aspects, provided herein is an insulated floor and/or floor panel comprising a composite floor mat that may be affixed (e.g., affixed using a hook and loop system) to the floor panels or to the floor of the assembled shelters disclosed herein. In certain aspects, the insulated floor mat comprises a composite insulating blanket (e.g., a 5-ply composite material) that may be installed onto the floor panels that form the base of the shelter container or crate. Upon assembly of the shelter, the insulated composite floor mat may be unfolded and affixed or otherwise sealed onto the floor of the assembled shelter by means of, for example, a hook and loop system that is located on or about the perimeter of the assembled shelter. An exemplary insulated composite floor mat is depicted in FIG. 12. As shown in FIG. 12, the insulated composite floor mat comprises an upward-facing surface (1) which may be constructed, for example, of a heavy duty, NFPA 701 compliant commercial tent floor, and which may be disposed onto a reflective insulation material (e.g., a radiant film or barrier) core (2) (e.g., SKYTECH by Winco), that is disposed onto each side of a high density e-glass filament blanket, and a scrim layer (3) to protect downward-facing reflective material.

Figure 13:
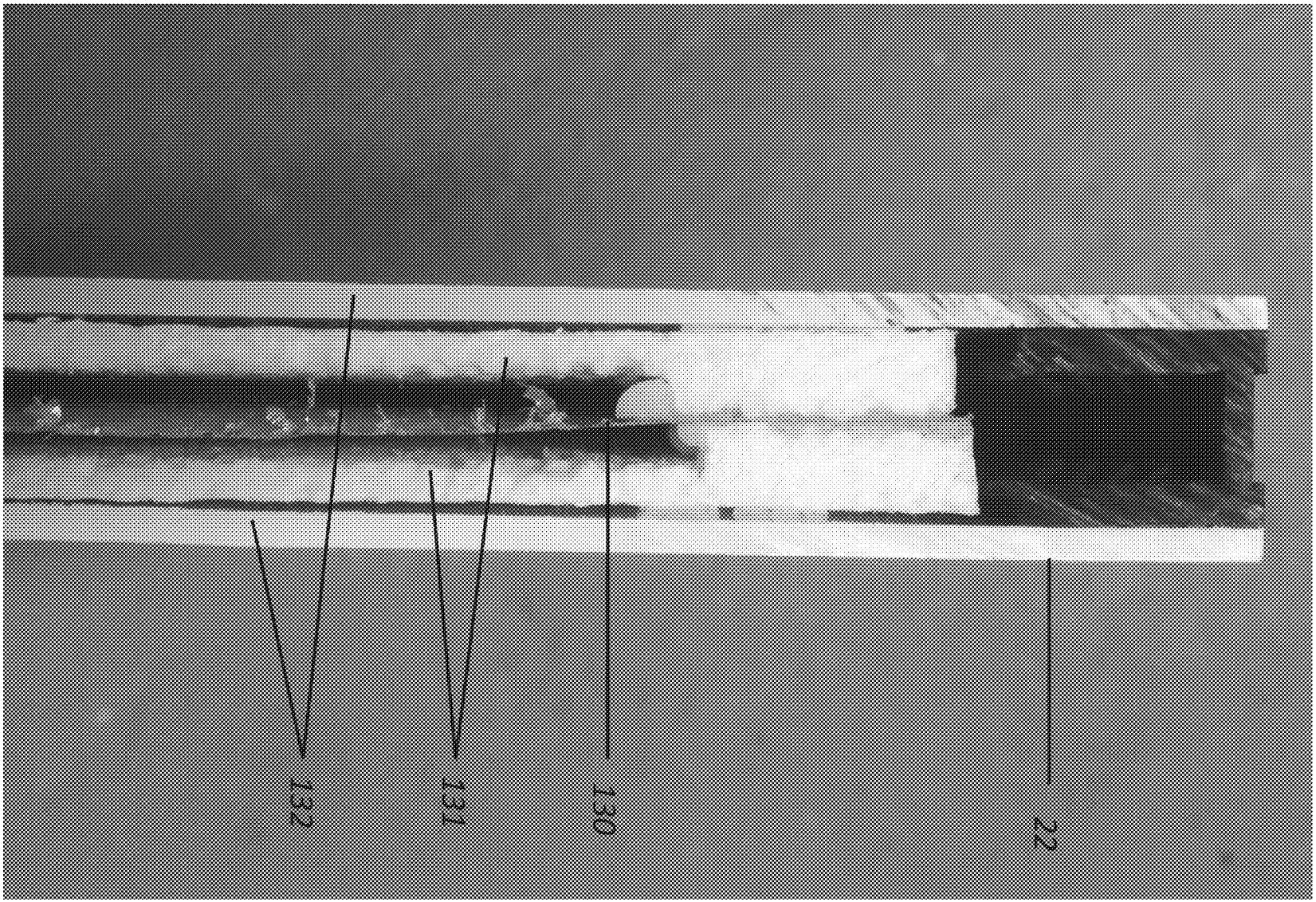
FIG. 13 depicts a cross section of an exemplary insulated wall panel (22) which is a five-layer composite consisting of a bi-directional radiant barrier film layer (1) (130) at the panel's centerline, conductive insulation layers (2) (131) that are used to sandwich the radiant barrier film (130), holding it in position between two air spaces and keeping almost 90% of the surface area as a radiative heat surface, and rigid ABS polycarbonate layers (3) (132) that form the outer layers of the insulated wall panel (22), providing a weather-tight seal and imparting structural rigidity to the composite material.

Also contemplated herein are insulated wall and/or floor panels. In certain embodiments, the thermally insulated and/or floor panels may also be formed of a rigid composite insulating material. For example, such thermally insulated composite panels may comprise a reflective insulation material core (e.g., a bidirectional radiant film or barrier core), onto which may be disposed a conductive insulating layer, and onto which a rigid exterior layer may be disposed, thereby forming the composite panel. In some embodiments, the composite insulating materials disclosed herein comprise a physical space or gap located between the reflective insulating material layer and the conductive insulating material layer. In certain aspects, the thermally insulated panels (e.g., a wall panel and/or a floor panel) comprise at least five layers and include a bi-directional radiant barrier. As shown in FIG. 13, such thermally insulated panels may comprise a bi-directional radiant barrier film (e.g., SUPER R PLUS by Innovative Insulation) at the panel's core or centerline. Such radiant films or barriers provide a means to trap heat in or to keep heat out of the shelter structure, depending upon the deployment conditions. In certain aspects, a conductive insulating material or layer (e.g., a machined EPS foam layer) may be disposed onto the radiant barrier film to surround or sandwich the radiant barrier film, thereby providing conductive thermal insulation and performing as a spacer. The two conductive insulating layers surround or sandwich the film, holding it in position between two air spaces, keeping almost 90% of the surface area as a radiative heat surface. A rigid exterior layer made of, for example, ABS-polycarbonate may be disposed onto the interior and exterior surfaces of the panel to protect the core insulating layers and to provide a weather tight seal and structural rigidity to the panel. In certain aspects, the resulting composite insulating panel is relatively thin in size (e.g., a width or thickness of about 100 mm, 90 mm, 80 mm, 70 mm, 60 mm, 50 mm, 45 mm, 40 mm, 35 mm, 30 mm, 25 mm, 24 mm, 23.5 mm, 23 mm, 22 mm, 21 mm, 20 mm, 15 mm, 10 mm, 5 mm, or less) compared to, for example, conventional insulated building materials.

It should be understood, that while certain aspects disclosed herein contemplate the use of the thermally insulated building materials and panels to form the floor panels or wall panels of the shelters and shelter systems disclosed herein, such thermally insulated building materials and panels may be useful for other purposes. Accordingly, also disclosed herein are thermally insulated composite building materials, as described in U.S. Provisional Application No. 62/287,231, filed on Jan. 26, 2016, the entire teachings of which are incorporated herein by reference. In particular, such thermally insulated building materials and panels may be used as a stand-alone product due to it is relatively thin (e.g., about 23.5 mm) size, and at +/−R-15, such panels perform as well as materials that are four to eight times as thick. In particular, such thermally insulated building materials and panels are useful in developing highly energy efficient sheathing for use in the conventional building industry. As energy costs continue to rise and building codes become more performance intensive, the thermally insulated panels disclosed herein may be used as an alternative or replacement for standard building materials, such as plywood.

One skilled in the art readily appreciates that the present invention is well adapted to carry out the objects and obtain the ends and advantages mentioned, as well as those inherent therein. The details of the description and the examples herein are representative of certain embodiments, are exemplary, and are not intended as limitations on the scope of the invention. Modifications therein and other uses will occur to those skilled in the art. These modifications are encompassed within the spirit of the invention. It will be readily apparent to a person skilled in the art that varying substitutions and modifications may be made to the invention disclosed herein without departing from the scope and spirit of the invention.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or all of the group members are present in, employed in, or otherwise relevant to a given product or process. Furthermore, it is to be understood that the invention provides all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise. It is contemplated that all embodiments described herein are applicable to all different aspects of the invention where appropriate. It is also contemplated that any of the embodiments or aspects can be freely combined with one or more other such embodiments or aspects whenever appropriate. Where elements are presented as lists, e.g., in Markush group or similar format, it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. For example, any one or more active agents, additives, ingredients, optional agents, types of organism, disorders, subjects, or combinations thereof, can be excluded.

What is claimed is:

1. A modular shelter comprising:

a plurality of walls, the walls comprising a plurality of rigid wall panels, each wall panel comprising two side faces, a front face, a back face, a top face and a bottom face substantially parallel to the top face, wherein the bottom face of each rigid wall panel comprises a tongue;

a plurality of rigid top caps, wherein a top end of the rigid wall panels is releasably coupled to the rigid top caps and thereby stabilize the walls of the shelter;

a floor, wherein the floor defines a perimeter of the shelter, and wherein the perimeter of the shelter comprises an extrusion affixed thereto or formed thereon, wherein the extrusion defines a channel and is configured to perpendicularly and releasably couple a bottom end of the rigid wall panels to the floor by mating with the tongue of the bottom face of the rigid wall panels such that the tongue is seated in the channel and the extrusion thereby releasably couples the bottom end of the rigid wall panels to the floor at a ninety degree angle; and a roof comprising a roof support structure and a roof structure; wherein the roof support structure comprises a plurality of rafters, each comprising a first end and a second end comprising a rafter supporting member coupled thereto; wherein the rigid top caps are configured to releasably couple to the rafter supporting members to thereby form a roof support structure; and wherein the roof structure is releasably coupled to the roof support structure to thereby form the roof.

2. The shelter of claim 1, wherein the floor comprises a plurality of rigid floor panels.

3. The shelter of claim 1, wherein the floor may be configured into a folded state.

4. The shelter of claim 3, wherein in the folded state the floor forms a container configured to securely house the shelter system in a stowed configuration.

5. The shelter of claim 1, wherein the shelter may be disassembled.

6. The shelter of claim 1, wherein the shelter may be assembled without tools.

7. The shelter of claim 1, wherein one or more of the floor panels, the wall panels and the roof structure are thermally insulated.

8. The shelter of claim 7, wherein one of more of the floor panels, the wall panels and the roof structure are thermally insulated with a composite insulating material comprising a radiant barrier core, onto which is disposed one or more conductive insulating intermediate layers and one or more rigid exterior layers.

9. The shelter of claim 1, wherein one or more of the floor panels, the wall panels and the roof structure are insulated with a radiant barrier film.

10. The shelter of claim 9, wherein the radiant barrier film comprises a bi-directional radiant barrier film.

11. The shelter of claim 1, wherein the rigid floor panels each comprise an underside, and wherein the underside of the rigid floor panels comprise a plurality of adjustable footings releasably coupled to the underside of the rigid floor panels.

12. The shelter of claim 1, wherein one or more of the wall panels comprise an expandable connector, and wherein the expandable connector is configured to releasably connect the shelter to an adjacent second shelter.

13. A modular shelter system comprising:

a plurality of rigid floor panels;

a plurality of rigid wall panels, each comprising two side faces, a front face, a back face, a top face and a bottom face substantially parallel to the top face, wherein the bottom face of each rigid wall panel comprises a tongue;

a plurality of rigid top caps;

a plurality of rafters, each comprising a first end and a second end comprising a rafter supporting member coupled thereto; and a roof structure;

wherein the rigid floor panels may be configured into a folded state and a deployed state, wherein in the folded state the rigid floor panels form a container configured to securely house the shelter system in a stowed configuration, and wherein in the deployed state the floor panels form a floor of the shelter;

wherein the floor of the shelter defines a perimeter of a shelter;

wherein the perimeter of the shelter comprises an extrusion affixed thereto or formed thereon and wherein the extrusion defines a channel and is configured to perpendicularly and releasably couple a bottom end of the rigid wall panels to the floor by mating with the tongue of the bottom face of the rigid wall panels such that the tongue is seated in the channel and the extrusion thereby releasably couples the bottom end of the rigid wall panels to the floor at a ninety degree angle to thereby form a wall of the shelter;

wherein a top end of the rigid wall panels are configured to releasably couple to the rigid top caps and thereby stabilize the walls of the shelter;

wherein the rigid top caps are configured to releasably couple to the rafter supporting members to thereby define a roof support structure; and wherein the roof support structure is configured to releasably couple to the roof structure to thereby form a roof of the shelter.

14. The shelter of claim 13, wherein the shelter may be disassembled.

15. The shelter of claim 13, wherein the shelter may be assembled without tools.

16. The shelter of claim 13, wherein one or more of the floor panels, the wall panels and the roof structure are thermally insulated.

17. The shelter of claim 16, wherein one or more of the floor panels, the wall panels and the roof structure are thermally insulated with a composite insulating material comprising a radiant barrier core, onto which is disposed one or more conductive insulating intermediate layers and one or more rigid exterior layers.

18. The shelter of claim 13, wherein one or more of the floor panels, the wall panels and the roof structure are insulated with a radiant barrier film.

19. The shelter of claim 18, wherein the radiant barrier film comprises a bi-directional radiant barrier film.

20. The shelter of claim 13, wherein one or more of the wall panels comprise an expandable connector, and wherein the expandable connector is configured to releasably connect the shelter to an adjacent second shelter.

21. A modular shelter comprising:

a plurality of walls, the walls comprising a plurality of rigid wall panels, the wall panels comprising a top end and a bottom end substantially parallel to the top end, wherein the bottom end of the rigid wall panels comprises a tongue, and wherein the tongue is thermoformed on the bottom end of the rigid wall panel;

a plurality of rigid top caps, wherein the top end of the rigid wall panels is releasably coupled to the rigid top caps and thereby stabilize the walls of the shelter;

a floor, wherein the floor defines a perimeter of the shelter, and wherein the perimeter of the shelter comprises an extrusion affixed thereto or formed thereon, wherein the extrusion defines a channel and is configured to perpendicularly and releasably couple the bottom end of the rigid wall panels to the floor by mating with the tongue of the bottom end of the rigid wall panels such that the extrusion engages the tongue and thereby releasably couples the bottom end of the rigid wall panels to the floor at a ninety degree angle; and a roof comprising a roof support structure and a roof structure; wherein the roof support structure comprises a plurality of rafters, each comprising a first end and a second end comprising a rafter supporting member coupled thereto; wherein the rigid top caps are configured to releasably couple to the rafter supporting members to thereby form a roof support structure; and wherein the roof structure is releasably coupled to the roof support structure to thereby form the roof.

22. A modular shelter system comprising:

a plurality of rigid floor panels;

a plurality of rigid wall panels, each comprising a top end and a bottom end substantially parallel to the top end, wherein the bottom end of the rigid wall panels comprises a tongue, and wherein the tongue is thermoformed on the bottom end of the rigid wall panel;

a plurality of rigid top caps;

a plurality of rafters, each comprising a first end and a second end comprising a rafter supporting member coupled thereto; and a roof structure;

wherein the rigid floor panels may be configured into a folded state and a deployed state, wherein in the folded state the rigid floor panels form a container configured to securely house the shelter system in a stowed configuration, and wherein in the deployed state the floor panels form a floor of the shelter;

wherein the floor of the shelter defines a perimeter of a shelter;

wherein the perimeter of the shelter comprises an extrusion affixed thereto or formed thereon and wherein the extrusion defines a channel and is configured to perpendicularly and releasably couple the bottom end of the rigid wall panels to the floor by mating with the tongue of the bottom end of the rigid wall panels such that the extrusion engages the tongue and thereby releasably couples the bottom end of the rigid wall panels to the floor at a ninety degree angle to thereby form a wall of the shelter;

wherein the top end of the rigid wall panels are configured to releasably couple to the rigid top caps and thereby stabilize the walls of the shelter;

wherein the rigid top caps are configured to releasably couple to the rafter supporting members to thereby define a roof support structure; and wherein the roof support structure is configured to releasably couple to the roof structure to thereby form a roof of the shelter.

* * * * *